US009232601B2

(12) United States Patent
Fushimi

(10) Patent No.: US 9,232,601 B2
(45) Date of Patent: Jan. 5, 2016

(54) LIGHTING SYSTEM

(71) Applicant: Panasonic Corporation, Osaka (JP)

(72) Inventor: Shigemi Fushimi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/036,164

(22) Filed: Sep. 25, 2013

(65) Prior Publication Data

US 2014/0091731 A1 Apr. 3, 2014

(30) Foreign Application Priority Data

Sep. 28, 2012 (JP) ..... 2012-218311

(51) Int. Cl.
*H05B 37/02* (2006.01)
*H05B 33/08* (2006.01)

(52) U.S. Cl.
CPC ..... *H05B 33/0863* (2013.01); *H05B 33/0845* (2013.01); *H05B 37/029* (2013.01); *H05B 37/0245* (2013.01)

(58) Field of Classification Search
CPC .. H05B 37/02; H05B 37/0272; H05B 37/029; H05B 37/0245; H05B 33/0863; H05B 33/0845
USPC ..... 315/149, 291, 292, 307, 308; 700/90, 700/275, 295, 296, 297
See application file for complete search history.

(56) References Cited

U.S. PATENT DOCUMENTS

2011/0230984 A1* 9/2011 Osawa et al. ..... 700/90
2011/0285515 A1* 11/2011 Fushimi et al. ..... 340/12.22

FOREIGN PATENT DOCUMENTS

EP 2 391 189 11/2011
JP 2006277972 A * 10/2006
WO WO 2008/001289 1/2008

OTHER PUBLICATIONS

The extended European Search Report dated Feb. 11, 2014 issued in the corresponding European application No. 13186265.8.

* cited by examiner

*Primary Examiner* — Thai Pham
(74) *Attorney, Agent, or Firm* — Renner, Otto, Boisselle & Sklar LLP

(57) ABSTRACT

The lighting system includes lighting devices and a controller of the lighting devices. The controller includes a display unit and a storage unit which stores area information including target areas in which the lighting devices are arranged, the identification information of the lighting devices, the lighting information regarding different lighting conditions of the lighting devices, and scene setting information regarding a state change pattern for changing a lighting state of one or more lighting devices allotted to each target area. The control unit controls the display unit to display a scene operation screen having pictorial signs each indicating one piece of scene setting information, and selects, if one of the pictorial signs is touched, a corresponding scene setting information represented by the pictorial sign, and controls the display unit to display a state change pattern of each lighting device allotted to the selected piece of scene setting information.

9 Claims, 29 Drawing Sheets

*FIG. 14A*

| SCENE NAME | SCENE NO. | CURVE A, B, C | STANDARD TRANSITION TIME |
|---|---|---|---|
| ENERGY SAVING | 1 | B | 5s |
| ALL TURNED OFF | 2 | B | 10s |
| TAKE A REST | 3 | C | 10s |
| DRINK ALCOHOL | 4 | C | 5s |
| LISTEN TO MUSIC | 5 | C | 10s |
| I AM HOME | 6 | A | 5s |
| DRAW PICTURE | 7 | A | 10s |
| ⋮ | ⋮ | ⋮ | |

*FIG. 14B*

| SCENE NO. | TARGET AREA | LIGHTING DEVICE IDENTIFICATION INFORMATION | LIGHTING INFORMATION (E.G., DIMMING RATIO(%)) |
|---|---|---|---|
| 1 | LIVING ROOM ONLY | 6 | 70 |
| | | 7 | 70 |
| | | 8 | 70 |
| 2 | ALL LIGHTING AREAS IN HOUSE | 1 | 0 |
| | | 2 | 0 |
| | | 3 | 0 |
| | | 4 | 0 |
| | | 5 | 0 |
| | | 6 | 0 |
| | | ⋮ | ⋮ |
| ⋮ | ⋮ | | |
| 6 | LIGHTING AREAS ONLY IN OUTER PORCH, INNER PORCH AND INNER PASSAGEWAY | 1 | 30 |
| | | 2 | 80 |
| | | 3 | 80 |
| | | 4 | 80 |
| | | 5 | 80 |

STATE CHANGE PATTERN

LIGHTING SYSTEM

FIELD OF THE INVENTION

The present invention relates to a lighting system for controlling a plurality of lighting devices in accordance with the control contents set by a controller.

BACKGROUND OF THE INVENTION

There is conventionally available a lighting setting device capable of performing lighting scene production by arbitrarily setting, depending on the intended use, the luminous intensities of lighting devices arranged within a room, the illuminances in the respective positions within a building, or the like. In order to create the lighting scenes, there has been used a dimming console provided with a plurality of faders for setting the output level of a specified dimming control signal with respect to each of the channels corresponding to the dimmers respectively connected to a plurality of lighting devices (see, e.g., JP 2000-311791A).

However, the dimming console disclosed in JP 2000-311791A involves the complexity in operation and a difficulty in knowing the correspondence relationship between the lighting devices and the faders. In view of this, there is available a lighting setting device which allows a user to operate the on/off states and the luminous intensities of lighting devices by using a display device capable of sensing the user's operation instruction, e.g., a liquid crystal touch panel, as a display unit for displaying the on/off state and the luminosity setting state of the lighting devices (see, e.g., JP 2006-277972A).

However, the lighting setting device disclosed in JP 2006-277972A is used in setting the luminous intensities of the lighting devices arranged on the ceiling of a building but is not intended for use in the lighting of a living room of a general house. Lighting devices in a general house are arranged not only on a ceiling but also in many different places such as a wall and a floor. Moreover, the lighting devices are diverse in the shape and the color of illumination light. In recent years, there is available a color temperature variable lighting device that uses different kinds of light emitting diodes (LEDs) or organic electroluminescent (EL) devices having different emission colors. Thus, the color temperature as well as the brightness (the dimming ratio) of illumination light may become a setting parameter.

However, the lighting control system disclosed in JP 2006-277972A mainly displays the schedule on the dimming ratio and fails to handle the color temperature. For that reason, it is not easy for a general user to perform, with respect to a plurality of lighting devices, the scene setting by which the lighting states such as the dimming ratio and the color temperature are changed over time.

SUMMARY OF THE INVENTION

In view of the above, the present invention provides a lighting system that enables a general user to intuitively set the scene setting information for changing the lighting states of lighting devices, while imaging a target area in which the lighting devices are arranged.

In accordance with an aspect of the present invention, there is provided a lighting system, including: one or more lighting devices; and a controller configured to set lighting control contents of the lighting devices, wherein the controller includes a display unit for displaying attribute information which includes identification information and lighting information of the lighting devices, an operation unit incorporated in the display unit and configured to detect an operation instruction, an input processing unit for acquiring coordinate information indicating a position of the operation instruction detected by the operation unit, a storage unit, a transmitting unit for transmitting a control signal including attribute information of a lighting device to the lighting devices, and a control unit for controlling said transmitting of the control signal of the transmitting unit to control lighting of the lighting device based on the coordinate information acquired by the input processing unit, wherein the storage unit stores area information including one or more target areas in which the lighting devices are arranged, the identification information of the lighting devices, the lighting information regarding different lighting conditions of the lighting devices, and a piece of scene setting information regarding a state change pattern for changing a lighting state of one or more lighting devices allotted to each target area; wherein the control unit controls the display unit to display a scene operation screen having one or more pictorial signs each indicating one piece of scene setting information stored in the storage unit, and selects, if the coordinate information acquired by the input processing unit indicates one of the pictorial signs, a corresponding piece of scene setting information represented by the indicated pictorial sign, and then controls the display unit to display a state change pattern of each lighting device allotted to the selected piece of scene setting information; and wherein each lighting device determines whether or not each lighting device itself is a control target, based on the identification information included in the control signal received from the controller, and gets turned on in accordance with the state change pattern if affirmative.

In the lighting system, the storage unit may further store a lighting condition curve that is obtained by correlating two lighting conditions of the lighting devices, and if a value of one of the two lighting conditions is selected, the control unit may select a value of the other of the two lighting conditions in accordance with the lighting condition curve.

Further, the two lighting conditions may be dimming ratio and color temperature of the lighting devices.

Further, the storage unit may further store another lighting condition curve that is obtained by correlating, based on the selected piece of scene setting information, a transition time required until each lighting device allotted to the selected piece of scene setting information is turned on with the one of the two lighting conditions, and the control unit may select, when a value of the transition time is determined by the operation instruction, a value of the one of the two lighting conditions in accordance with said another lighting condition curve, and select a value of the other of the two lighting conditions in accordance with the lighting condition curve.

Further, the input processing unit may measure a time period for which the position of the operation instruction detected by the operation unit is being touched, and the control unit may change the transition time depending on a time period for which the indicated pictorial sign is being touched by the operation instruction on the scene operation screen.

Further, the controller may further include an orientation sensor for detecting orientation of the controller, the input processing unit may measure a time period for which the position of the operation instruction detected by the operation unit is being touched, and the control unit may change the transition time depending on a time period for which the indicated pictorial sign is being touch by the operation instruction on the scene operation screen and the orientation of the controller detected by the orientation sensor.

Further, depending on the orientation of the controller detected by the orientation sensor, the control unit may control the display unit to change arrangement direction of the pictorial signs on the scene operation screen.

Further, the input processing unit may measure a migration length and a migration velocity of the operation instruction detected by the operation unit, and the control unit may control the display unit to display the pictorial signs in a scrolling manner on the scene operation screen depending on the migration length and the migration velocity of the operation instruction.

Further, if one of the pictorial signs or a vicinity of the one of the pictorial signs is selected by the operation instruction on the scene operation screen, the control unit may control the display unit to arrange the selected pictorial sign at the center of the scene operation screen in a highlighted manner.

Further, storage unit may store the number of selection of each of the pictorial signs, and the control unit may control the display unit to display the pictorial signs on the scene operation screen depending on the number of selection of each of the pictorial signs stored in the storage unit.

Further, the control unit may control the display unit to two-dimensionally or three-dimensionally display a first operation screen having a first image that symbolizes area information of a target area assigned to the selected piece of scene setting information and identification information of lighting devices in the assigned target area; if one of the lighting devices in the first image is selected as a control target by the operation instruction on the first operation screen, the control unit may control the display unit to dialog-display a second operation screen having a second image that symbolizes lighting information of the selected lighting device such that the second operation screen is superposed on the first operation screen; and if the lighting information of the lighting device is selected on the second operation screen, the control unit may control the display unit to display, on the first operation screen, the selected lighting device in a highlighted manner such that the selected lighting information is reflected on the first image.

In accordance with the present invention, if an operation instruction is made on the scene operation screen displayed on the display unit of the controller with respect to the pictorial sign indicating the scene setting information, specific scene setting information is selected. The state change pattern of the allotted lighting device is displayed in the form of a diagram on the display unit. Therefore, by merely touching the pictorial sign indicating the scene setting information, it is possible for even a general user to intuitively set the scene setting information while imaging the target area in which the lighting device is arranged.

BRIEF DESCRIPTION OF THE DRAWINGS

The objects and features of the present invention will become apparent from the following description of embodiments, given in conjunction with the accompanying drawings, in which:

FIG. 14A is a view showing scene names and the second lighting condition curves and standard transition time allotted to respective scene setting information;

FIG. 14B is a view showing target areas related to the scene setting information, the identification information and the lighting information;

DETAILED DESCRIPTION OF THE EMBODIMENTS

A lighting system in accordance with one embodiment of the present invention will now be described with reference to the accompanying drawings.

Figure 1:
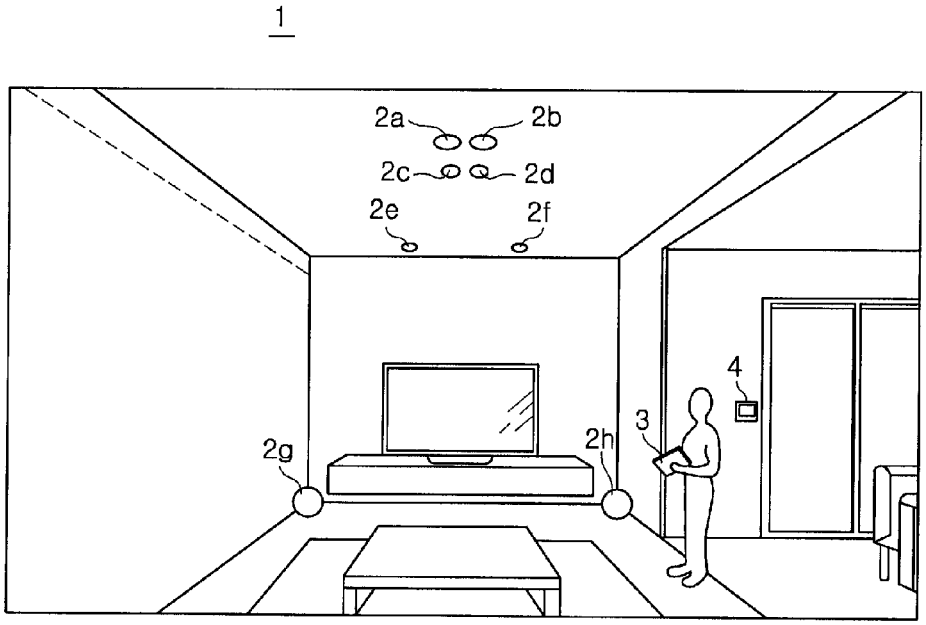
FIG. 1 is a one-point projection view showing the configuration of a lighting system in accordance with an embodiment of the present invention.

Referring to FIG. 1, the lighting system 1 includes a plurality of lighting devices 2*a* to 2*h* (hereinafter collectively referred to as "lighting devices 2") and a controller 3 for setting the lighting control contents of the lighting devices 2. The lighting system 1 is applicably used within a general house or within a building. In the present embodiment, the lighting system 1 further includes a control device 4 for turning on/off the lighting devices 2 in response to a control signal sent from the controller 3. However, the control device 4 may be omitted in a case where all the lighting devices 2 can be directly controlled by the controller 3.

Each of the lighting devices 2 has its own identification information. If the identification information and lighting control contents (lighting information) of the lighting devices 2, which are to be control targets, are set by the controller 3, the lighting devices 2 of the control targets receive the set lighting information from the controller 3 directly or via the control device 4. The term "identification information" refers to information by which each of the lighting devices 2 can be identified. The identification information is not limited to the individual identification number (ID) assigned to every lighting device but includes an icon that symbolizes each of the lighting devices 2.

The lighting information mainly includes the dimming ratio (amount of light) and the color temperature of illumination light. Additionally, the lighting information includes a hue, saturation, and brightness, and further includes the optical angle and the beam angle of each lighting device 2. The identification information and lighting information of the lighting devices 2 are collectively referred to as attribute information of the lighting devices 2.

In this embodiment, the lighting devices 2*a* to 2*f*, which are lighting devices (down-lights) of a fixed type, are installed in a ceiling. The lighting devices 2*g* and 2*h*, which are lighting devices of a movable type, are provided on a floor. However, as the lighting devices 2, either of the fixed type in which the installation place is fixed to a predetermined place or the movable type in which the installation place is movable may be used. The lighting device of a fixed type is not limited to the down-light illustrated in the drawings but may include, e.g., a ceiling light, a base light, a spotlight, a pendant light, a cornice lighting device and a cove lighting device. The lighting device of a movable type may include, e.g., a wiring duct type of spotlight movable along a rail fixed to a place such as a ceiling, and an elevatable type of pendant light vertically movable along a rail fixed to a place such as a wall.

In addition, the lighting device of a movable type may include, e.g., a stand light, a lantern, a torch, a display, and a digital signage. The lighting device serving as both the fixed type and the movable type may include an assimilation lighting device in which a light source is built in furniture or a construction member to reduce its presence. In the assimilation lighting device, the object in which the light source is built has an opening for emitting light. The opening for emitting light is covered with a transparent light guide plate. The number of lighting devices 2, and a shape and an arrangement of each lighting device 2 are not limited to the illustrated ones.

Each of the lighting devices 2 is appropriately provided with an optical member or a reflection plate depending on the shape and the intended use thereof. The optical member includes, e.g., a variety of lenses, prisms, louvers and filters. The filters may include filters having the functions of light diffusion, light collection, polarization, wavelength cut, wavelength conversion or the like, and one suitable for its intended use among those filters is employed. The optical member is formed of a light transmitting plastic, a glass, a coated metal plate or the like. A reflection plate, which is used to reflect light in a desired direction, is composed of an alumite reflection plate, an aluminum-deposited reflection plate, a silver-deposited reflection plate, a resin reflection plate, a cold mirror or the like. The reflection plate has a reflection surface formed of a mirror surface, a light diffusion surface or the like.

If necessary, each of the lighting devices 2 may be provided with a liquid lens or a liquid crystal lens that changes the transmittance or the directivity of illumination light depending on an input voltage. Further, each of the lighting devices 2 may be provided with a movable optical lens that changes the orientation of an optical axis of illumination light or with a drive device that changes the orientation of the lighting device itself. In addition, the beam angle of illumination light may be made variable by, e.g., making the distance between a light source and an optical member variable.

Figure 2:
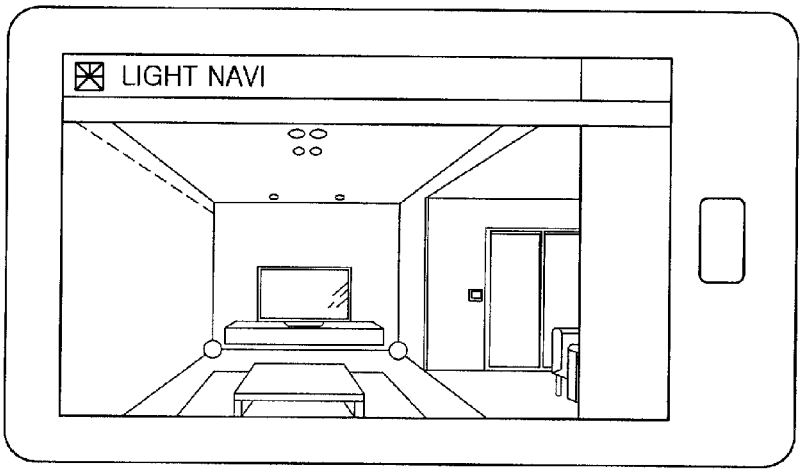
FIG. 2 is a front view of a controller used in the lighting system.

The controller 3 is a terminal freely movable to an arbitrary place within a house. The controller 3 transmits control signals to the lighting devices 2 and the control device 4 through wireless communication. The controller 3 includes a touch panel for displaying an image and enabling a user to input an operation instruction by touching the image with a finger. As shown in FIG. 2, a multi-functional portable terminal such as a tablet or a smart phone on which dedicated software is installed is preferably used as the controller 3. The attribute information of the lighting devices 2 to be later described is displayed on the touch panel of the controller 3. A terminal dedicated to the lighting system 1 may be used as the controller 3. It may also be possible to use, as the controller 3, a game remote controller, a digital camera, a PDA, a music player, a portable lighting device represented by a lantern or a torch, a portable wrist watch, or the like.

The control device 4 can perform wired or wireless communication with the fixed lighting devices 2*a* to 2*f* and perform wireless communication with the movable lighting devices 2*g* and 2*h*. Moreover, the control device 4 can perform wireless communication with the controller 3. As shown in FIG. 1, the control device 4 is attached to a wall within a house, but an operation unit (or a display unit) of the control device 4 to be later described may be detachable from a wall surface.

Figure 3A:
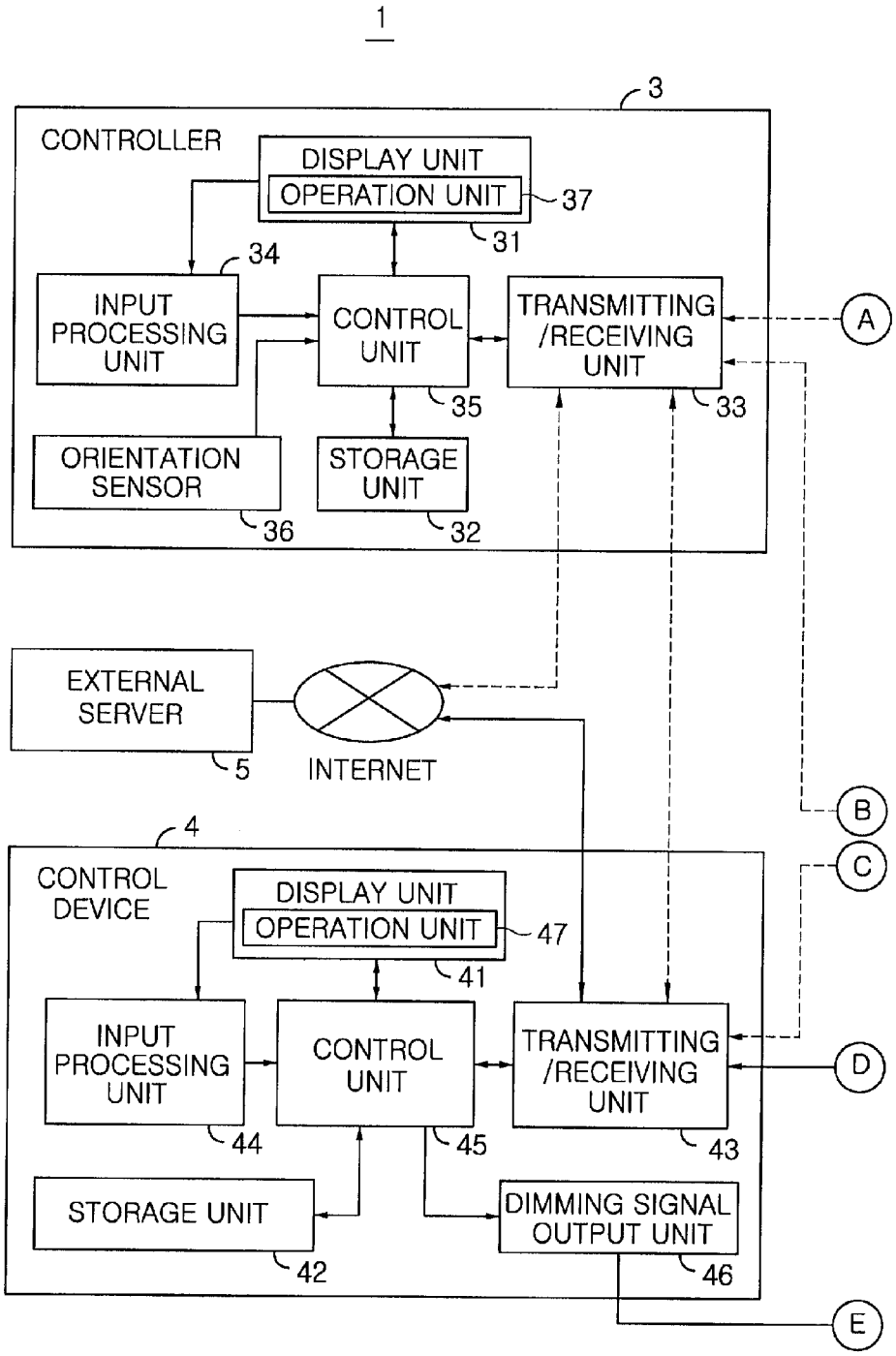
FIGS. 3A and 3B are a block diagram of the lighting system.
Figure 3B:
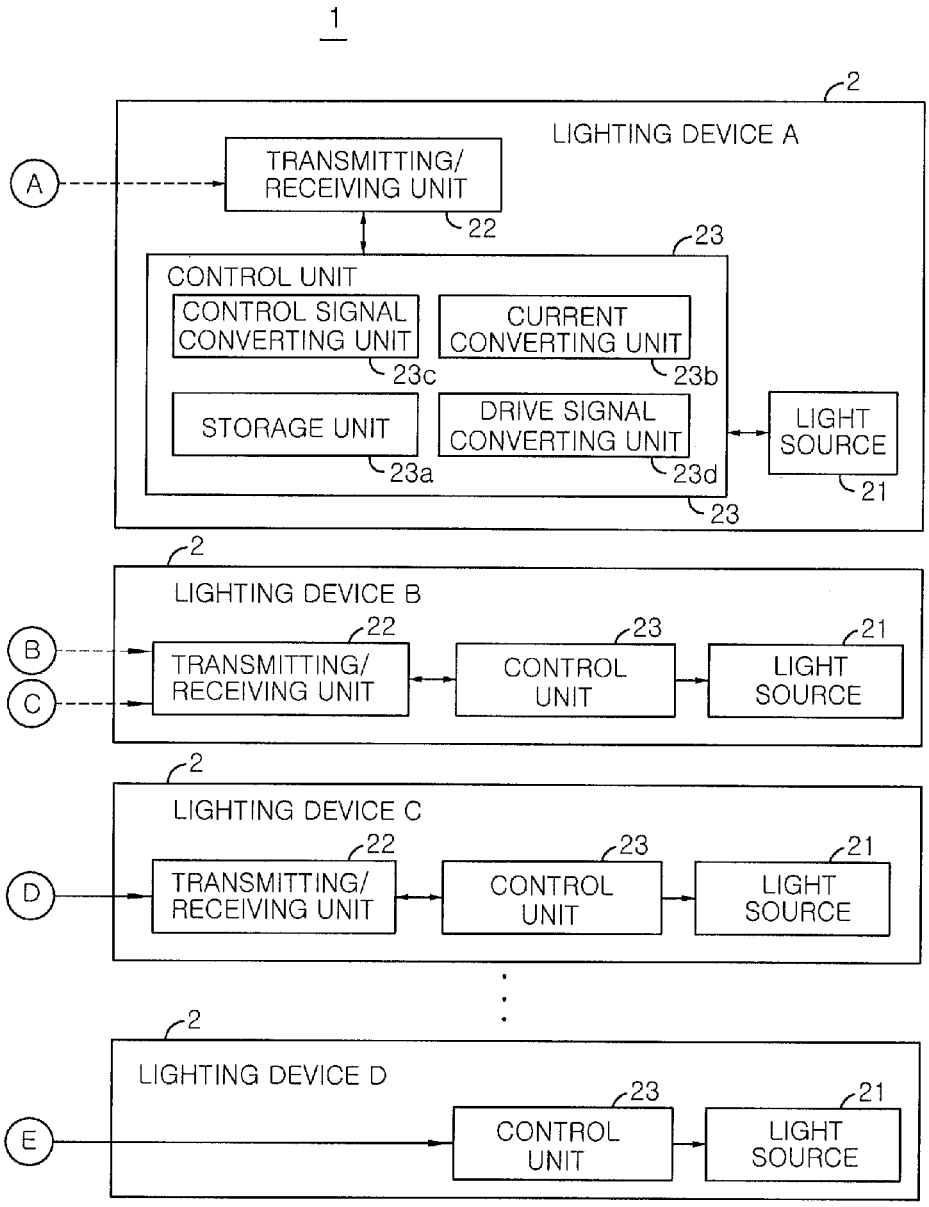

FIGS. 3A and 3B show a block configuration example of the lighting system 1. In FIGS. 3A and 3B, the broken line arrows interconnecting component blocks indicate wireless communication and the solid line arrows indicate wired communication. The lighting devices 2 (A to D) illustrated in FIGS. 3A and 3B do not correspond to the lighting devices 2*a* to 2*h* shown in FIG. 1. The lighting device A is wirelessly connected to the controller 3. The lighting device B is wirelessly connected to the controller 3 and the control device 4. The lighting devices C and D are wired-connected to the control device 4. The lighting device D is a conventional lighting device having no transmitting/receiving unit. The controller 3 and the control device 4 are connected to the lighting devices 2 arranged in the lighting system 1 and are also connected through the Internet to an external server 5 which stores data on the identification information of lighting devices arranged outside the lighting system 1. Thus, the controller 3 and the control device 4 can download various kinds of data from the external server 5. All the control units 23 of the lighting devices 2 (A to D) have the same configuration.

The controller 3 includes a display unit 31 for displaying the attribute information of the lighting devices 2, a storage unit 32 for storing the attribute information and a transmitting/receiving unit 33 for transmitting and receiving control signals containing the attribute information to and from the lighting devices 2. The display unit 31 is the touch panel described above and incorporates an operation unit 37 for sensing an operation instruction. A touch panel different from the display unit 31 or a button type switch may be used as the operation unit 37. The controller 3 further includes an input processing unit 34, a control unit 35 and an orientation sensor 36. The input processing unit 34 acquires coordinate information indicative of the position of the operation instruction sensed by the operation unit 37. The control unit 35 drives the display unit 31 and the like and controls the transmitting/receiving unit 33 to transmit/receive a control signal. The orientation sensor 36 detects the orientation of the controller 3. The controller 3 further includes a battery (not shown) having a predetermined capacity and a control power supply unit (not shown) for obtaining necessary electric power from an external power supply.

The display unit 31 may preferably employ a display device capable of not only sensing a user instruction but displaying, such as a liquid crystal touch panel. The touch panel (the operation unit 37) of the display unit 31 detects the coordinates of the position pressed by a finger tip or a pen on the display unit 31 and outputs position coordinate information indicating the detected position coordinates to the input processing unit 34.

The storage unit 32 stores: area information including a target area in which the lighting devices 2 are arranged; the identification information of the lighting devices 2 arranged in the target area; and the lighting information of the lighting devices 2 concerned with multiple lighting conditions different from each other, as the attribute information. The storage unit 32 of the present embodiment further stores scene setting information regarding state change patterns by which the lighting states of the lighting devices 2 are changed with the passage of time. Details of the above-described various kinds of information including the state change patterns and the scene setting information regarding the state change patterns will be described later. A general-purpose memory such as an EEPROM is used as the storage unit 32.

The input processing unit 34 acquires the instruction coordinate information, which indicates the position of the operation instruction made by a user, from the position coordinate information sensed by the operation unit 37. The instruction coordinate information is outputted to the control unit 35 by using software for transferring the instruction coordinate information received from a display driver of the display unit 31 to the control unit 35. The instruction coordinate information is expressed as x, y coordinates.

The software transfers a multiple number of instruction coordinate information to the control unit 35 at the same time. Based on the operation instruction detected by the operation unit 37, operation information including touch-on/touch-off information, elapsed time (a period of contact-time) from the touch-on state to the touch-off state, and the travel length and the travel time of the instruction coordinate information in the touch-on state is simultaneously transferred to the control unit 35 through the software. More specifically, based on the operation information, the software identifies whether the user's operation is a double click, a long click (e.g., for 2 seconds or more), a drag, a scroll or the like and inputs the result to the control unit 35.

The touch-on/touch-off information may be included in the instruction coordinate information. For example, when the instruction coordinate information of the operation instruction is outside a predetermined region in the xy-coordinate plane, the state is regarded as the touch-off operation, and when the instruction coordinate information is inside the predetermined region in the xy-coordinate plane, the state is regarded as the touch-on operation. Thus, the touch-on/touch-off information can be included in the coordinate expression.

In accordance with the instruction coordinate information and the operation information from the input processing unit 34 based on the operation instruction, the control unit 35 makes a display on the display unit 31 of the controller 3, and generates various control signals and controls transmission/reception of the control signals with respect to the lighting devices 2 and the control device 4. The control unit 35 is composed of a microprocessing unit (MPU), a memory, and the like, and a processing program is stored in the memory to achieve the control of the control unit 35. The control unit 35 may be achieved by a dedicated hardware.

The transmitting/receiving unit 33 of the controller 3 transmits and receives data to and from the control device 4 and the lighting devices 2 through wired or wireless communication. The structure of the transmitted/received data is formed of a "communication command", "identification information of the lighting devices" and "lighting information of the lighting devices (e.g., the dimming ratio and the color temperature)". If the wireless communication is, e.g., a wireless local area network (LAN) (such as Wi-Fi), a user datagram protocol (UDP) is substantially used. As the wireless communication, it may also be possible to use a visible light communication protocol, an infrared data communication protocol (IrDA), a radio frequency (RF) protocol, a short-range wireless communication protocol (IEEE 802.15.1) or a specified low-power radio. As the wired communication, it is possible to use, e.g., a digital addressable lighting interface (DALI), a wired LAN protocol (IEEE 802.3, etc.) or a power line communication.

The orientation sensor 36 senses a posture of the controller 3, namely an azimuth angle and a tilt angle (elevation angle) of the controller 3. The orientation sensor 36 is composed of, e.g., a geomagnetic sensor and an acceleration sensor. The geomagnetic sensor measures the azimuth of the controller 3 every a given period of time (e.g., every 10 ms). The controller 3 integrates the sensor output values detected by the acceleration sensor every 10 ms to specify the tilt angle thereof. A single axis sensor, a dual axes sensor or an XYZ three axes sensor is used as the acceleration sensor.

Instead of the geomagnetic sensor and the acceleration sensor, a gyro sensor may be used as the orientation sensor 36. The gyro sensor detects the variations of an angular velocity caused by the change of the posture of the controller 3. The variations of the angular velocity are integrated to specify the azimuth angle and the tilt angle of the controller 3, namely the direction angle of a remote controller. In this case, it is possible to use, e.g., a gas rate gyro sensor, a rotary gyro sensor, a vibratory gyro sensor or an optical fiber gyro sensor, as the gyro sensor. It may also be possible to use a plurality of gyro sensors.

Figure 4:
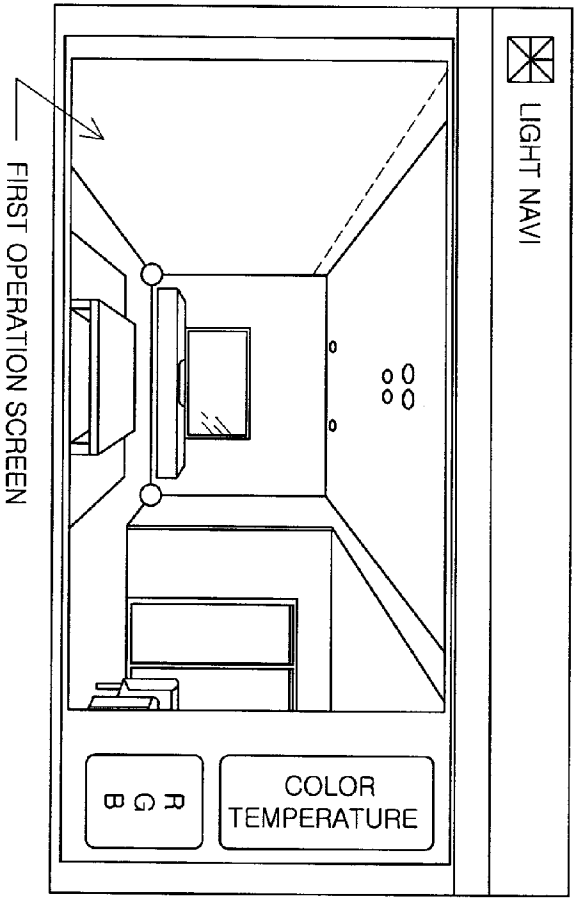
FIG. 4 is a view for explaining a first operation screen displayed on the controller in the lighting system.
Figure 5:
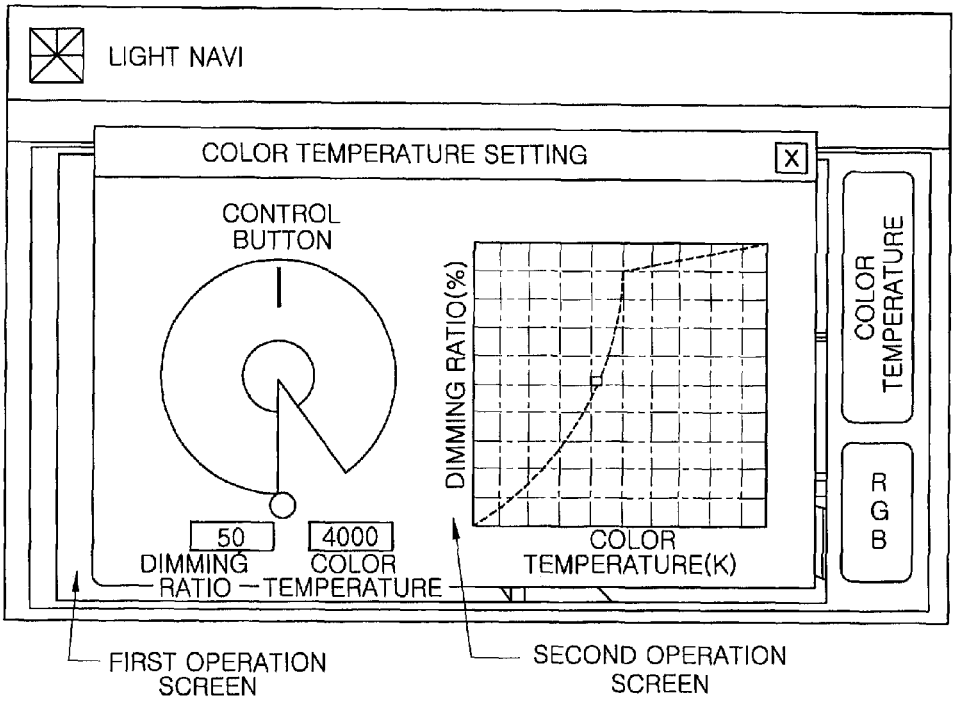
FIG. 5 is a view for explaining a second operation screen superposed on the first operation screen displayed on the controller.

The control unit 35 of the controller 3 allows the display unit 31 to two-dimensionally or three-dimensionally display a first operation screen having a first image that symbolizes the area information and the identification information of the lighting devices 2 and a second operation screen having a second image that symbolizes the lighting information of the lighting devices 2. FIG. 4 shows an image in which the first operation screen is three-dimensionally displayed by the display unit 31. When a user selects the lighting devices 2, which are to be control targets, on the first operation screen through the operation instruction, the display unit 31 dialog-displays, as shown in FIG. 5, the second operation screen having a second image, which corresponds to the selected lighting devices 2, such that the second operation screen is superposed on the first operation screen.

Information on the first image includes a one-point projection view of a lighting space corresponding to the area information and a bitmap or a script (e.g., a postscript) which represents symbols of one or more lighting devices corresponding to the identification information of the lighting devices 2. In the first image shown in FIG. 4, the xyz coordinate system of the lighting devices 2 (2*a* to 2*h*) of the lighting system 1 shown in FIG. 1 is arranged in the three-dimensional space of a room having the lighting devices 2 arranged therein.

The image arranged in the three-dimensional space of a room, namely the first image indicating the area information is not limited to a floor, a wall and a ceiling but may include a desk, a shelf, an electric appliance and the like. To obtain the first image, for example, a user takes a still image of the space in which the lighting devices 2 are arranged, and the still image is taken into the controller 3 through a variety of information-carrying terminals that uses a flash memory or the like. Alternatively, a space image view and an illustration of a shelf and furniture or 3D-CAD data thereof are downloaded from the aforementioned external server (see FIGS. 3A and 3B) and may be used as the first image.

Insofar a user can navigate an image of the lighting space which is to be a control target, the first image indicating the area information may be configured by, e.g., data of a two-dimensional room arrangement view to be described later. In this case, the first image is displayed as an image in which the lighting devices 2 are arranged on a two-dimensional plane (on a room arrangement view). The data structure of the first image is not limited to the aforementioned example. For example, it is preferred that the first image corresponding to the identification information of the lighting devices 2 is drawn in conformity with the sizes and shapes of the lighting devices 2.

As shown in FIG. 5, information on the second image is displayed in a view showing, e.g., operation menus or menu items. The second image is a bitmap, a script such as HTML or XML, or the like. The data structure thereof does not matter. The storage unit 32 may store the instruction coordinates acquired with respect to the second image and a memory table in which a plurality of attribute information is correlated. In FIG. 5, a control button for the operation instruction and a graph for defining the lighting conditions of the lighting devices 2 are displayed as an example of the second image. In the graph, there is depicted a first lighting condition curve (a dimming/toning curve), which is derived by correlating two kinds of lighting conditions, i.e., the dimming ratio and the color temperature in this embodiment. However, the two kinds of lighting conditions correlated each other in the graph showing the dimming/toning curve (in the second image) are not limited to the dimming ratio and the color temperature. For example, in a case of using the lighting devices 2 having a variable light irradiation range, other lighting information such as a lighting beam angle or the like may be correlated with one of the aforementioned lighting conditions (the dimming ratio and the color temperature). The detailed procedure of the operation instruction using the second operation screen having the second image will be described later.

Referring again to FIGS. 3A and 3B, description will now be made on the configuration of the lighting devices 2 (A, B and C). Each of the lighting devices 2 includes a light source 21, a transmitting/receiving unit 22 for receiving a control signal from the controller 3 or a control device 4, and a control unit 23 for controlling the light source 21 in accordance with the lighting information contained in the control signal received by the transmitting/receiving unit 22. The light source 21 is formed by combining light-emitting bodies, e.g., a plurality of LEDs having different emission colors so that the color temperature of irradiated light can be changed. The transmitting/receiving unit 22 performs transmission/reception with respect to the controller 3 and/or the control device 4 through wireless communication or wired communication. The transmitting/receiving unit 22 has a configuration corresponding to the configuration of the transmitting/receiving unit 33 of the controller 3.

In the present embodiment, the light source 21 includes three-color light emitting elements (light emitting diodes) R, G and B having a red color (R), a green color (G) and a blue color (B), respectively. The three-color light emitting elements are not limited to light emitting diodes but may include, e.g., organic EL devices, inorganic EL devices, fluorescent lamps, high-intensity discharge (HID) lamps, incandescent lamps and LED bulbs. The color of the illumination light obtained by mixing colors of the light emitting elements R, G and B can be varied by changing the ratio of the light amounts YR, YG and YB of the light emitting elements R, G and B. If the light amounts YR, YG and YB are changed in keeping with the ratio of the light amounts YR, YG and YB, the light amount of the illumination light can be changed without changing its color.

The light emission amount of light emitting diodes is determined by the amount of power supply (the amount of an electric current flowing through the respective light emitting diodes). Accordingly, the light color and light amount of the illumination light can be adjusted by increasing or decreasing the amount of electric power (electric current) supplied from the control unit 23 to the respective light emitting elements R, G and B. Moreover, the light color of the illumination light can be designated based on the color temperature by determining the light amounts YR, YG and YB of the respective light emitting elements R, G and B serving as the illumination light sources such that the chromaticity of the illumination light can be changed substantially along the locus of a blackbody.

A suitable number of the light emitting elements R, G and B used in the light source 21 are arranged within a package, depending on the sizes of the light emitting elements R, G and B. The light source 21 may be a module having a housing or a light-transmitting panel arranged in the peripheral edge thereof. The housing is preferably made of a less brittle material. The material of the housing includes, e.g., a plastic, a composite material formed by mixing a plastic with a reinforcing material such as a glass fiber, a metal such as an aluminum alloy, an iron and a magnesium alloy, and a wood material. A suitable number of the modules are arranged within each of the lighting devices 2 depending on the sizes of the lighting devices 2. It may be possible to employ a configuration in which a module can be added on at the rear side of the lighting device 2.

The control unit 23 of the lighting devices 2 (A, B and c) includes a storage unit 23*a* for storing the identification information of the lighting devices 2 and the like, a current converting unit 23*b* for converting an AC voltage of a commercial power supply or the like to a desired DC voltage, a control signal converting unit 23*c* for analyzing the control signal from the controller 3 received by the transmitting/receiving unit 22 to generate and transfer a new control signal in accordance with the lighting information contained in the control signal from the controller 3, and a drive signal converting unit 23*d* for outputting a drive signal to the light source 21.

The storage unit 23*a* includes a general-purpose lighting-controlling microcomputer and a memory. The storage unit 23*a* stores the identification information of the lighting devices 2 and information on the affiliation within the system. For example, the storage unit 23*a* stores information set by a dual in-line package (DIP) switch or the like. The identification information of each of the lighting devices 2 may be a unique identifier such as a global internet protocol (IP) address or a media access control (MAC) address.

The current converting unit 23*b* includes a switch circuit, a voltage converting circuit and the like and supplies a predetermined electric current. The current converting unit 23*b* may be replaced by a primary battery or a secondary battery, and the predetermined electric current may be supplied from this battery. The battery is suitable for use in the movable lighting devices 2*g* and 2*h* (see FIG. 1). The capacity of the battery is selected depending on the electric energy consumed by the lighting devices 2. The secondary battery may have such a configuration that coils are mounted in a charger (power supplying side) and the battery (power receiving side), respectively and an electric power is contactlessly transferred without interposing metallic terminals therebetween by virtue of electromagnetic induction between the coils. In this case, if the movable lighting devices 2 are not in use, charging can be performed by just placing the movable lighting devices 2 on the charger. This helps enhance the ease of use.

Figure 6A:
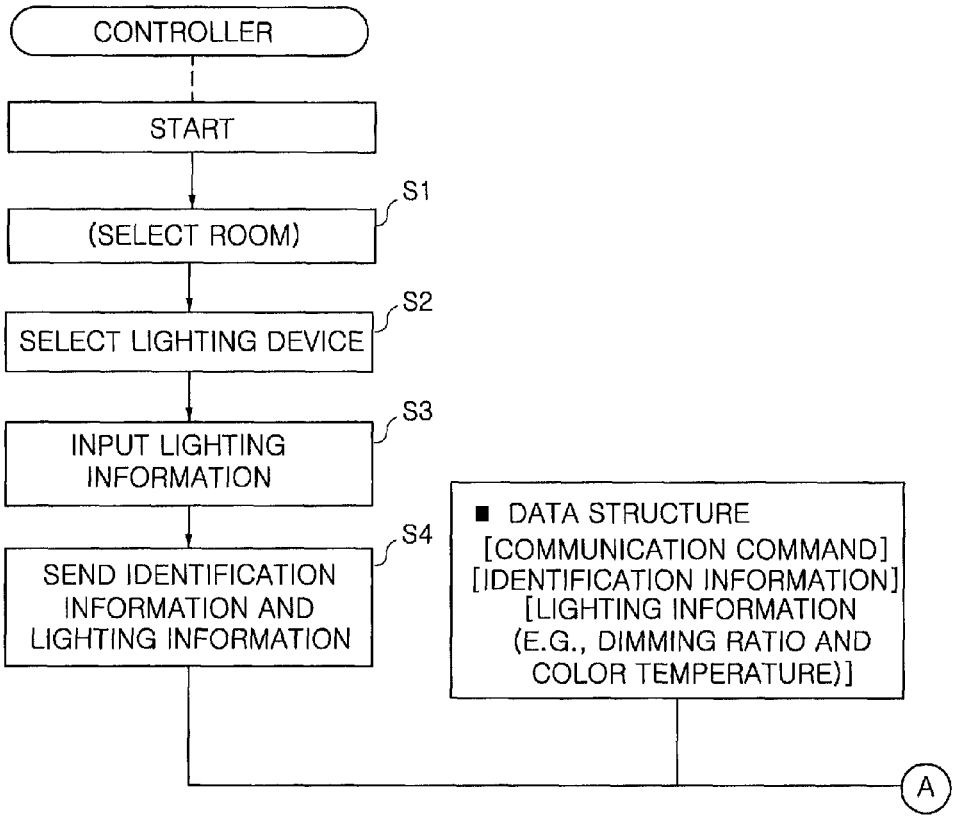
FIGS. 6A and 6B are a flowchart illustrating one example of a data transmitting/receiving operation of the controller and the lighting devices in the lighting system.
Figure 6B:
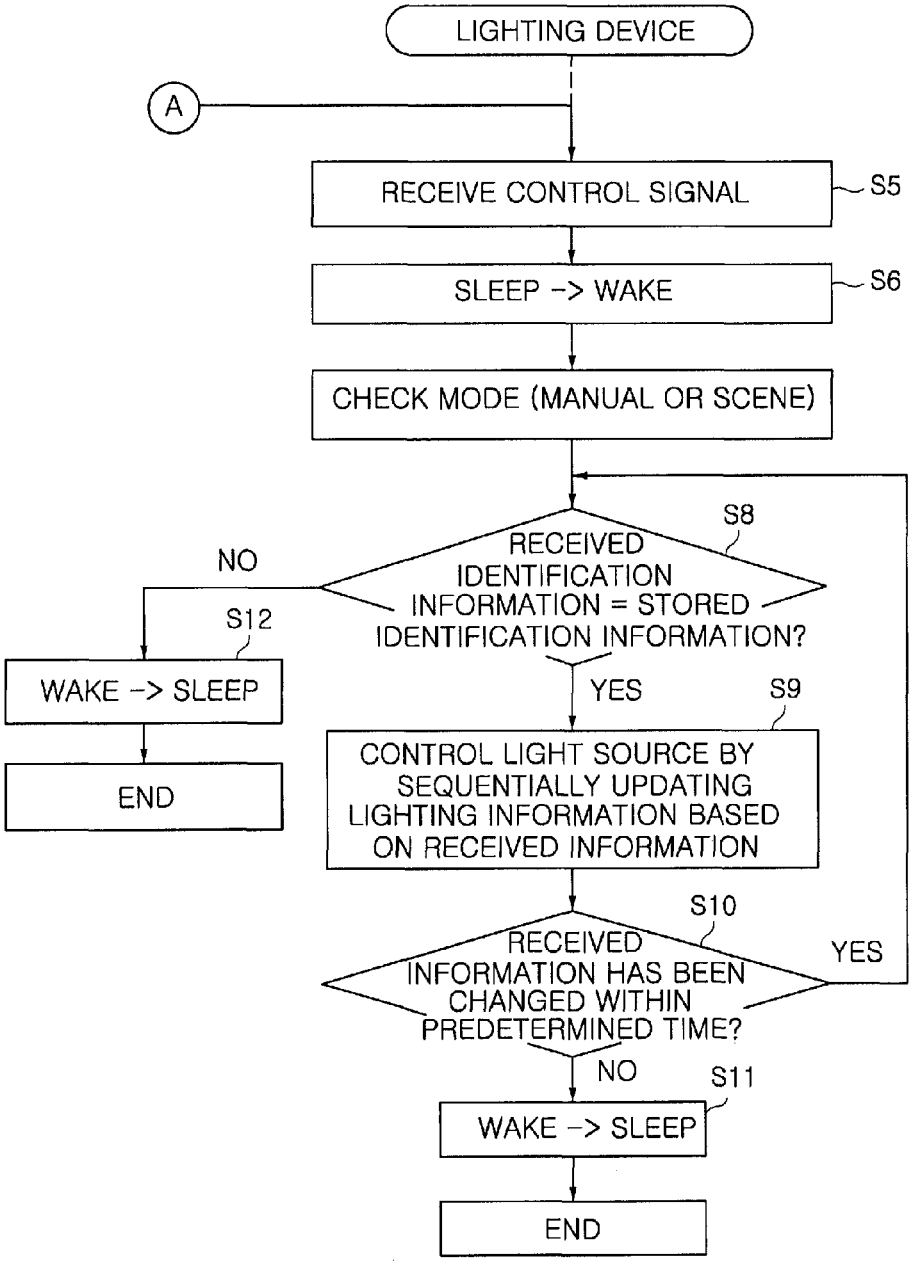

Now, the flow of the data transmission/reception performed between the controller 3 and the lighting devices (the lighting devices A and B in FIGS. 3A and 3B) will be described with reference to FIGS. 3A, 3B and 6.

When a target area (room) and a lighting devices 2 are selected in the operation unit 37 in step S1 and S2 and the lighting information of the selected lighting device 2 is set in step S3, the controller 3 sends a control signal containing the identification information and lighting information of the selected lighting device 2 to all the associated lighting devices 2 in step S4.

In each of the lighting devices 2, when the transmitting/receiving unit 22 receives the control signal from the controller 3 in step S5, a mode is changed from a sleep mode to a wake mode in step S6. Then, the control signal converting unit 23*c* of the control unit 23 compares the identification information contained in the control signal received by the transmitting/receiving unit 22 to its own identification information stored in the storage unit 23*a* in step S8. If the two pieces of identification information thus compared are equal to each other, the flow goes to step S9, and if not, the flow goes to step S12 to start the sleep mode.

In step S9, if the lighting information of the lighting device 2 contained in the control signal received by the transmitting/receiving unit 22 is only one kind of information, e.g., only dimming ratio information, the control signal converting unit 23*c* converts the dimming ratio information as the control signal to a PWM signal having a corresponding on-duty ratio and outputs the PWM signal to the drive signal converting unit 23*d*. Then, in the same step S9, the drive signal converting unit 23*d* outputs a duty signal to turn on the light source 21.

If the received information is changed within a predetermined period of time in step S10, the flow returns to step S8 and the two pieces of the identification information stated above are again compared to each other. If the received information is not changed within the predetermined period of time in step S10, the sleep mode is started in step S11 and the light source 21 is continuously turned on based on a constant duty signal.

More specifically, if the lighting information of the lighting device 2 contained in the received control signal is only one kind of lighting information such as the dimming ratio information, the control signal converting unit 23*c* converts the dimming ratio information as the control signal to a PWM signal having a corresponding on-duty ratio and outputs the PWM signal to the drive signal converting unit 23*d*. Alternatively, if the lighting information of the lighting device 2 contained in the received control signal is two or more kinds of independent information, e.g., dimming ratio information and color temperature information, the control signal converting unit 23*c* converts the dimming ratio information and the color temperature information as the control signal to a packet data signal and outputs the packet data signal to the drive signal converting unit 23*d*.

Referring again to FIGS. 3A and 3B, description will now be made on the configuration of the control device 4. Just like the controller 3, the control device 4 includes a display unit 41 for displaying predetermined attribute information, a storage unit 42 for storing the attribute information, and a transmitting/receiving unit 43 for receiving a control signal containing the attribute information from the controller 3 and transmitting a control signal to the lighting devices 2. The display unit 41 is a touch panel and incorporates an operation unit 47 for sensing an operation instruction.

The control device 4 further includes an input processing unit 44 for acquiring the coordinate information indicating a position of the operation instruction sensed by the operation unit 47 and a control unit 45 for driving the display unit 41 and controlling the transmitting/receiving unit 43 to transmit/receive a control signal. The control device 4 further includes a dimming signal output unit 46 for dimming the lighting device D that has no transmitting/receiving unit.

Hereinafter, a flow of the data transmission/reception performed between the controller 3 and the lighting devices (the lighting devices B and C shown in FIGS. 3A and 3B) through the control device 4 will be described with reference to FIGS. 3A and 3B and FIGS. 7A and 7B.

Figure 7A:
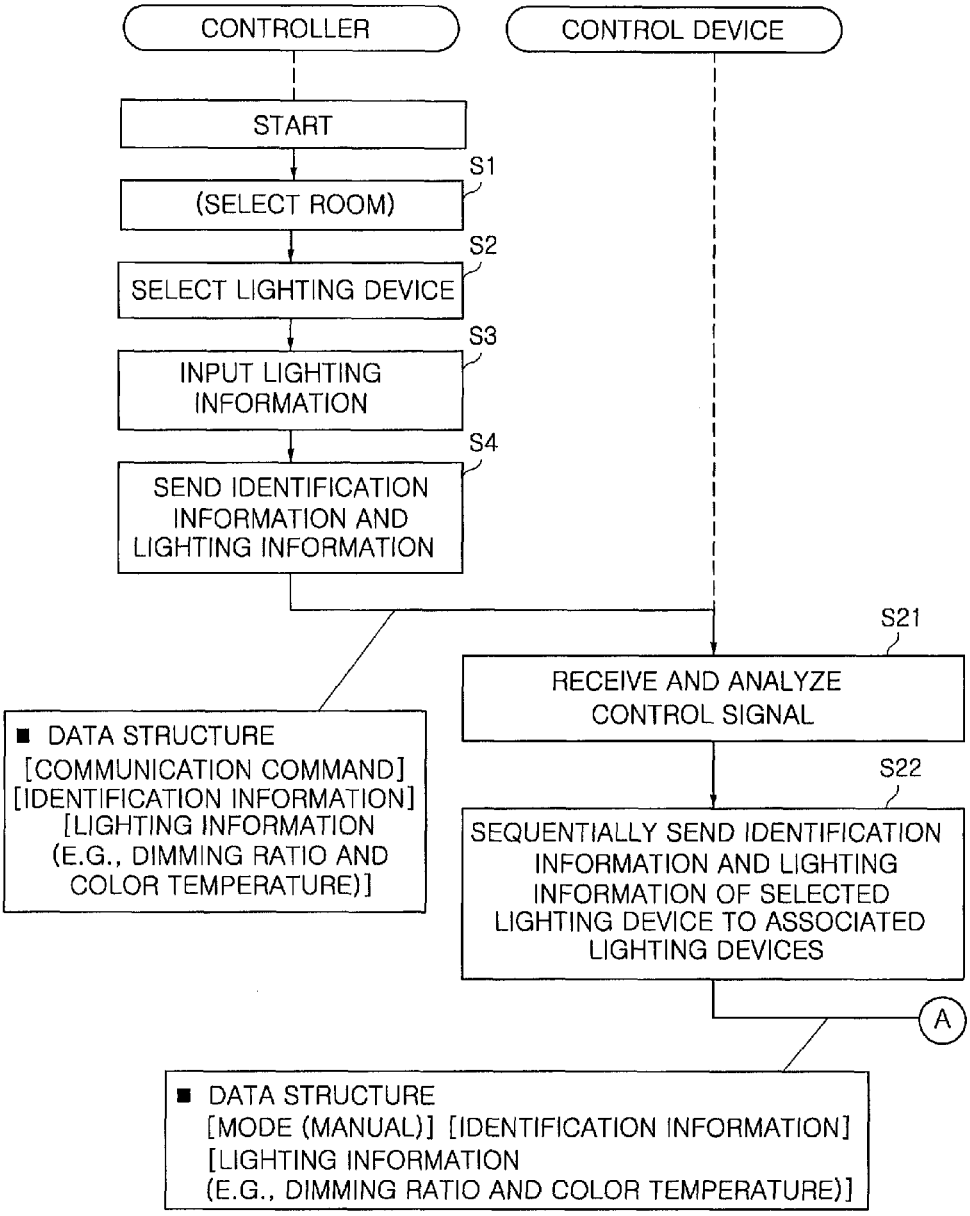
FIGS. 7A and 7B are a flowchart illustrating one example of a data transmitting/receiving operation performed through a control device of the lighting system.
Figure 7B:
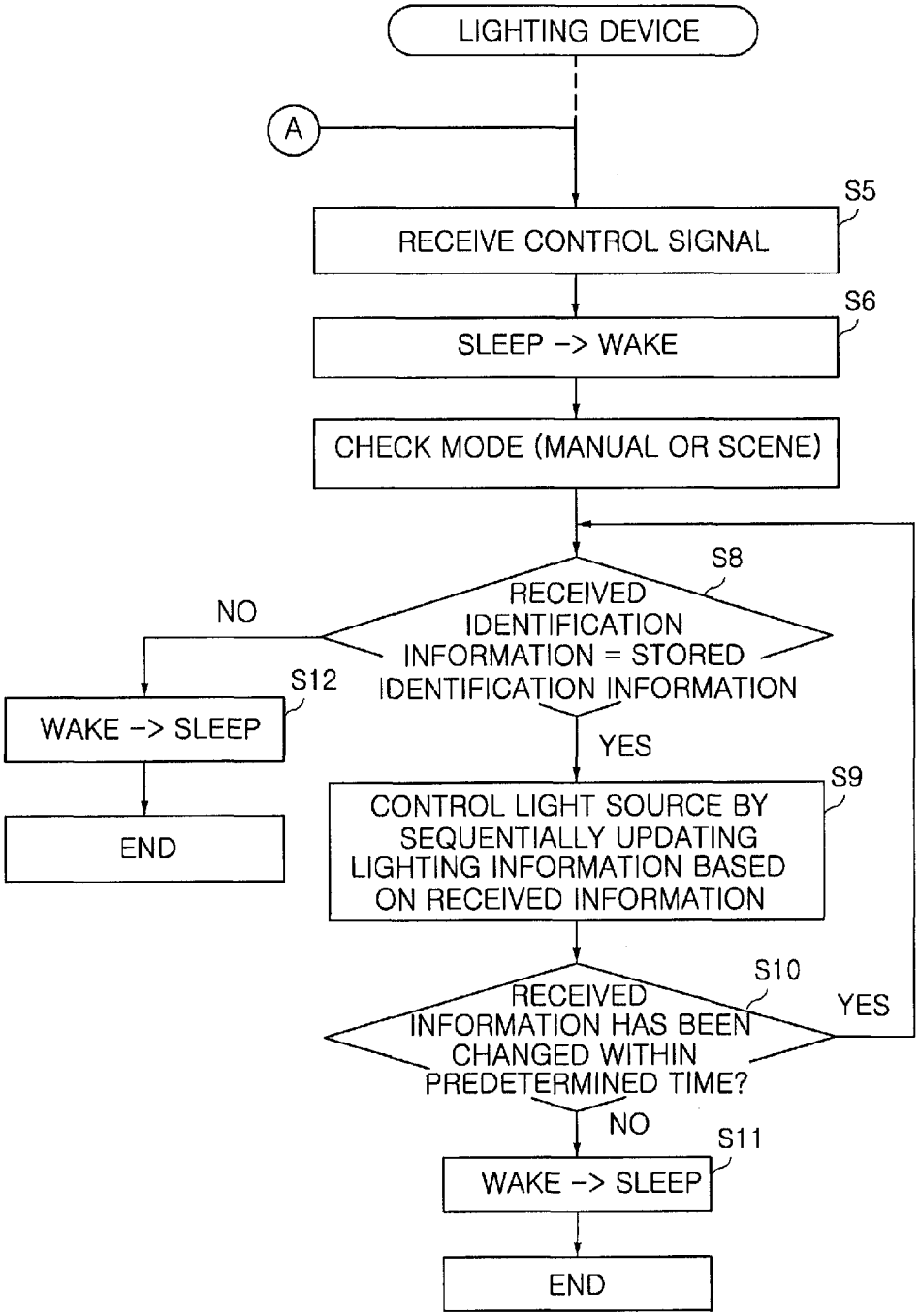
Figure 8A:
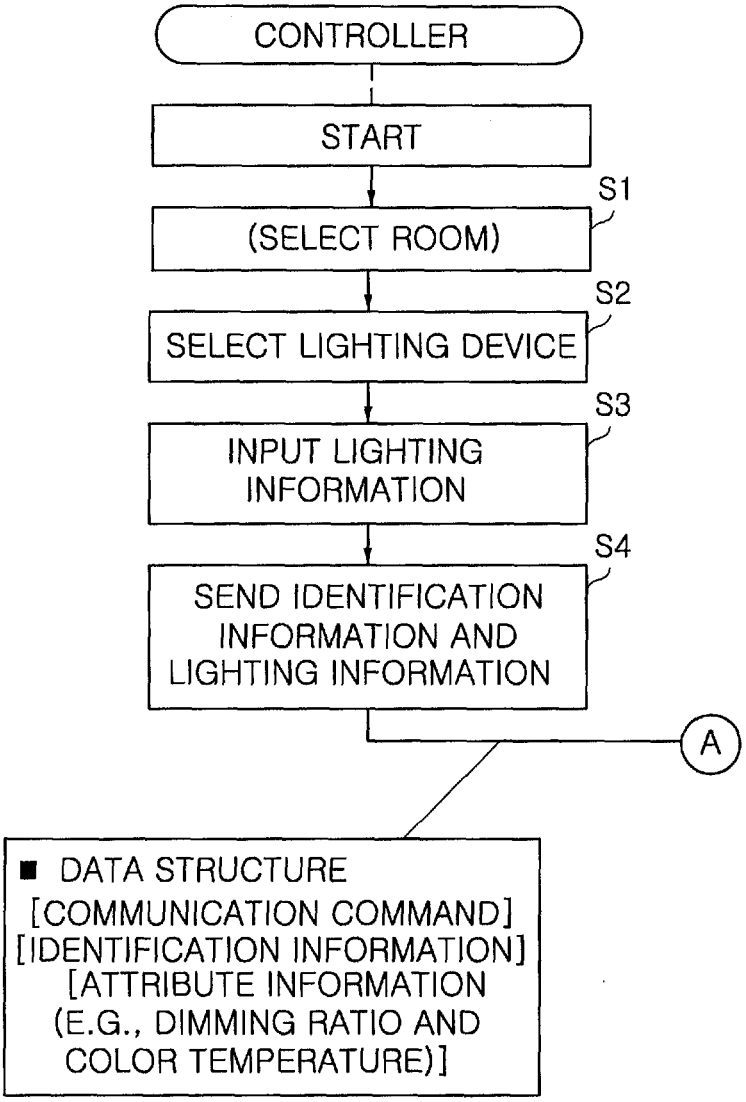
FIGS. 8A and 8B are a flowchart illustrating another example of the data transmitting/receiving operation performed through the control device of the lighting system.
Figure 8B:
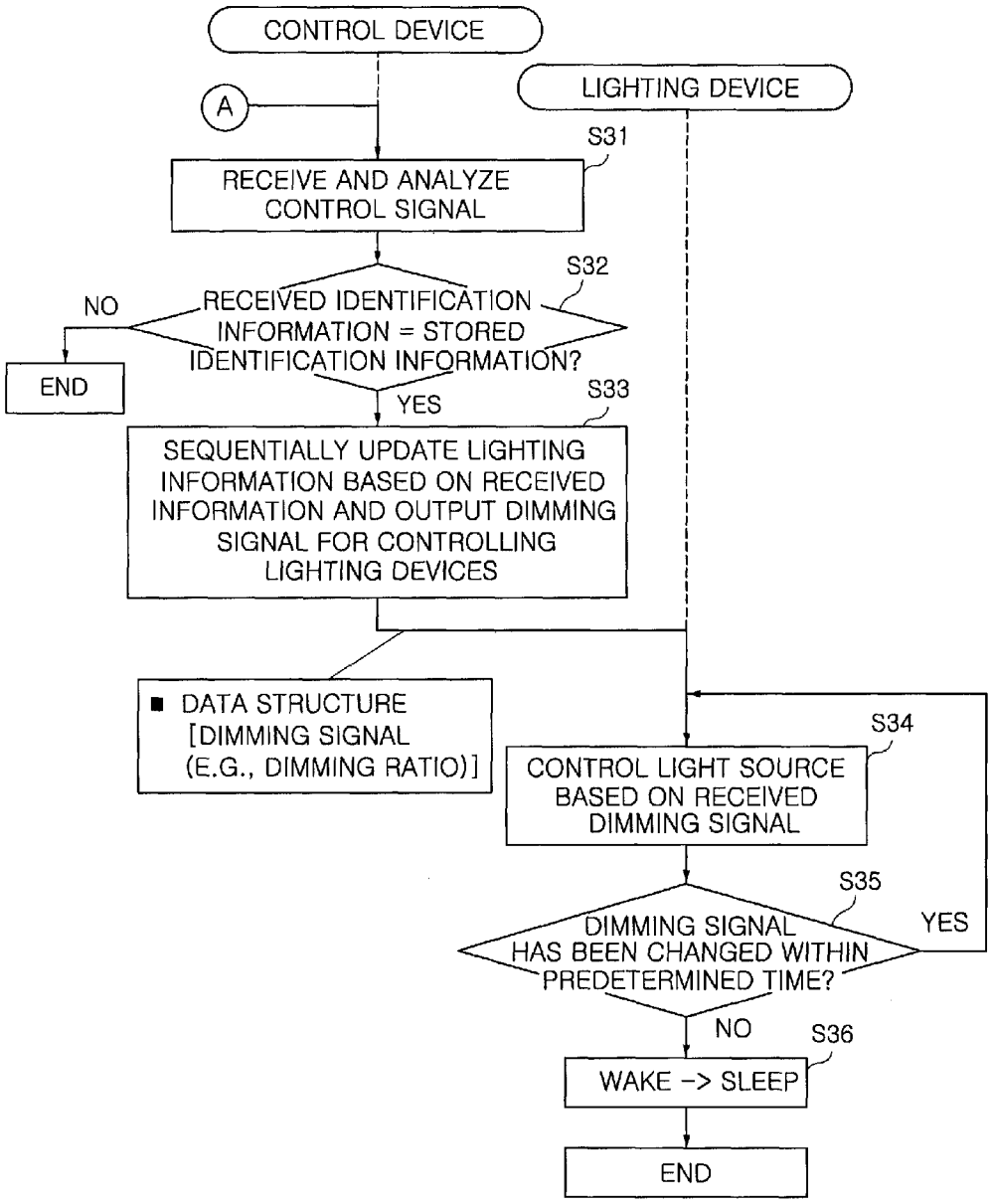

In this flow, the control device 4 receives the control signal containing the identification information and lighting information of the selected lighting device 2 from the controller 3 and analyzes the received control signal in step S21. In step S22, the control device 4 sends the control signal to the associated lighting devices 2. The associated lighting devices 2 may be all the lighting devices 2 or may be limited to some lighting devices 2. Other procedures remain the same as those of the flow shown in FIGS. 6A and 6B. The flow shown in FIGS. 7A and 7B is applied to, e.g., a case where the lighting device B can also be controlled by the existing control device 4 or a case where the lighting device C is wired-connected to the control device 4.

Next, a flow of the data transmission/reception performed between the controller 3 and the lighting device 2 (the lighting device D shown in FIGS. 3A and 3B) through the control device 4 will be described with reference to FIGS. 3A, 3B and FIGS. 8A and 8B. In this flow, the control device 4 receives the control signal containing the identification information and lighting information of the selected lighting device 2 from the controller 3 and analyzes the received control signal in step S31.

In the flows shown in FIGS. 6A and 6B and FIGS. 7A and 7B, each of the lighting devices 2 compares the identification information contained in the control signal received by the transmitting/receiving unit 22 to its own identification information stored in the storage unit 23*a*. In contrast, in this flow shown in FIGS. 8A and 8B, the above comparison is carried out in the control device 4, i.e., the control device 4 compares, in step S32, the identification information contained in the control signal received by the transmitting/receiving unit 43 with the identification information of the lighting device D, as a control target of the control device 4, stored in the storage unit 42. If the two pieces of identification information is equal to each other, the dimming signal output unit 46 of the control device 4 outputs a predetermined dimming signal for controlling the lighting device D directly to the lighting device D wired-connected thereto in step S33.

The lighting device D is a conventional lighting device having no specific communication terminal (a transmitting/receiving unit) or no advanced control unit for comparing a variety of control information. The control unit 23 of the lighting device D turns on the light source 21 in accordance with the dimming signal received from the control device 4 in step S34. Thereafter, in the lighting device D, it is checked whether or not the dimming signal is changed within a predetermined period of time in step S35. If the change has occurred, the flow returns to step S34, and if not, the sleep mode is started in step S36.

Figure 9:
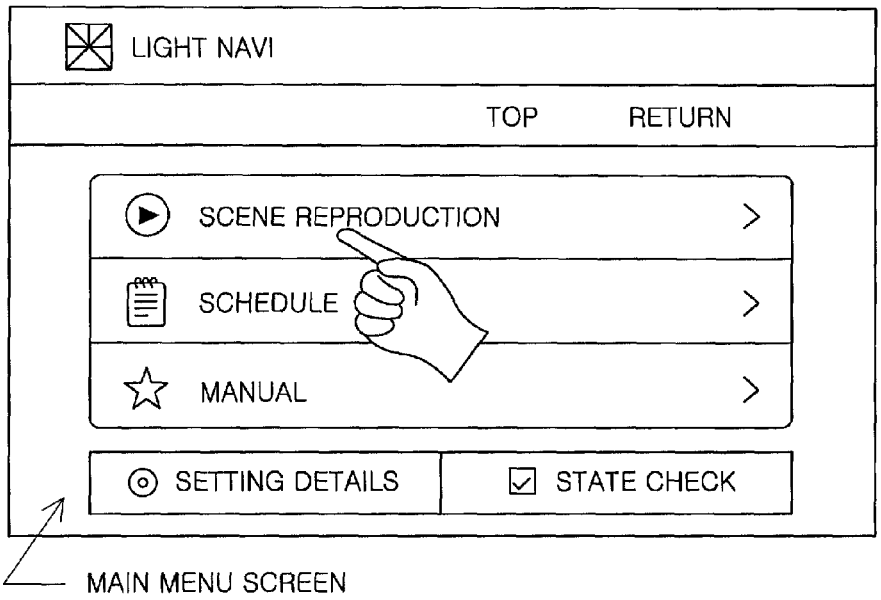
FIG. 9 is a view for explaining a main menu screen displayed on the controller.

Next, a scene reproduction procedure of the lighting devices 2 using the controller 3 in the lighting system 1 will be described with reference to FIGS. 9 to 14. First, if a user operates the controller 3 and starts up a built-in lighting system software "LIGHT NAVI", a main menu screen shown in FIG. 9 is displayed on the display unit 31 of the controller 3. In this main menu screen, "SCENE REPRODUCTION", "SCHEDULE" and "MANUAL" are displayed as main commands with "SETTING DETAILS" and "STATE CHECK" displayed as subcommands.

Figure 10:
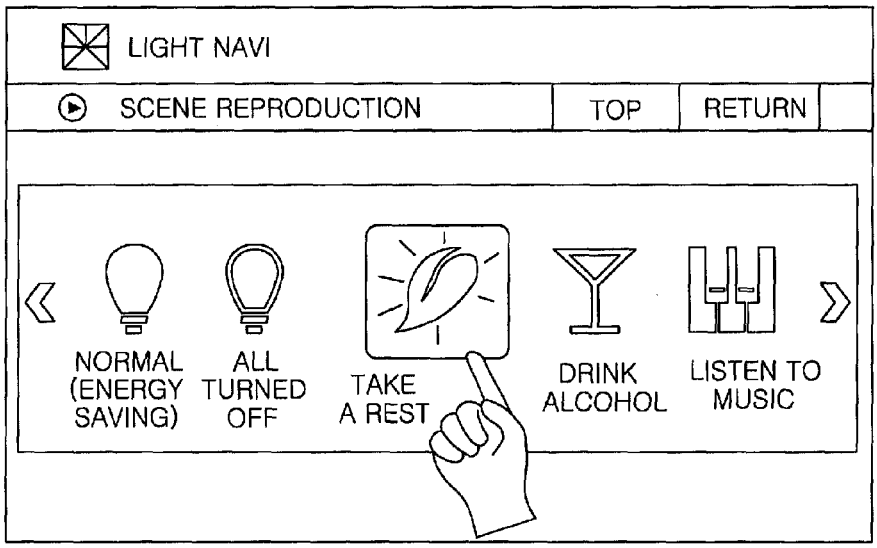
FIG. 10 is a view for explaining a scene operation screen displayed on the controller.

If a user touches the command "SCENE REPRODUCTION" with a finger, the display unit 31 displays a scene operation screen as shown in FIG. 10. On the scene operation screen, pictorial signs (icons and letters) indicating scene setting information are arranged. The scene setting information includes information on state change patterns for changing the lighting states such as the dimming ratios and the color temperatures of lighting devices 2 arranged in a target area. The state change pattern is to pattern different kinds of lighting conditions of lighting devices 2 assigned to produce a scene depending on the purpose for which it is employed. The scene setting information on the state change patterns can be labeled with names (nicknames) conforming to the respective purposes.

In the following description, the dimming ratio and the color temperature are taken as examples of the different kinds of lighting conditions. However, the different kinds of lighting conditions may include, e.g., a direction of an optical axis and an irradiation range of illumination light, depending on the attributes of the lighting devices 2.

In order to allocate the lighting devices 2 to the respective scene setting information, the "SETTING DETAILS" button is selected from the main menu screen shown in FIG. 9 and a setting of a lighting scene (not shown) is selected. Then, a screen similar to the scene operation screen shown in FIG. 10 is displayed. If a pictorial sign corresponding to a scene to be set is selected on the screen, a first operation screen, which shows the lighting devices 2 arranged in the target area, is displayed. Thereafter, if a symbol indicating the identification information of the lighting device 2 is touched on the first operation screen, the touched symbol is surrounded by a frame and the lighting device 2 indicated by the symbol is allotted to the scene setting information.

The scene setting information includes the information on the state change patterns which are determined in accordance with various purposes such as "NORMAL (ENERGY SAVING)", "ALL TURNED OFF", "TAKE A REST", "DRINK ALCOHOL", and "LISTEN TO MUSIC". As shown in FIG. 10, pictorial signs indicating the respective scene setting information are displayed on the display unit 31. As illustrated in FIG. 14A, the scene setting information may further include "I AM HOME", "DRAW A PICTURE", and the like. The scene setting information can be downloaded from the aforementioned external server 5 or can be personally produced by a user.

In the scene reproduction, if a user touches one of the pictorial signs on the scene operation screen displayed on the display unit 31, the controller 3 selects the scene setting information corresponding to the touched pictorial sign and determines the state change pattern to be realized in the lighting devices 2. Even when not only the exact position of the pictorial sign but also the periphery of the pictorial sign is touched, the input processing unit 34 determines that the pictorial sign has been touched. If the scene setting information corresponding to the touched pictorial sign is selected, the display unit 31 arranges, as shown in FIG. 10, the pictorial sign ("TAKE A REST" in the present embodiment) at the center of the scene operation screen in a highlighted manner. The touched pictorial sign is surrounded by a white frame. This enables a user to confirm the selected scene setting information at a first glance.

Figure 11:
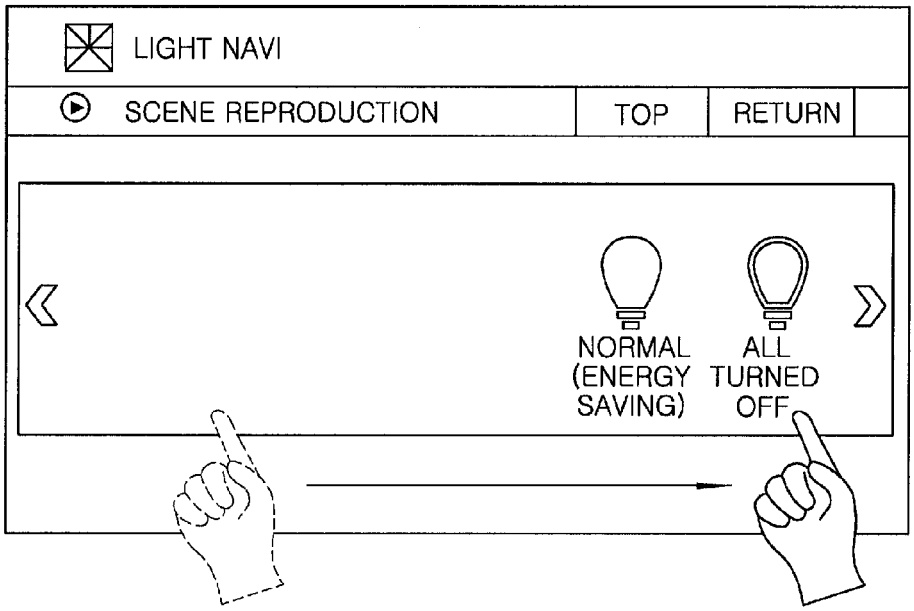
FIG. 11 is a view for explaining a scrolling manner of the scene operation screen displayed on the controller.

The input processing unit 34 measures the travel length and the travel velocity of the operation instruction sensed by the operation unit 37. Depending on the travel length and the travel velocity of the operation instruction, the display unit 31 displays the pictorial signs, indicating the scene setting information, on the scene operation screen in a scrolling manner. Accordingly, as shown in FIG. 11, if a user moves his or her finger while keeping touch on the scene operation screen, the pictorial signs are scrolled along the moving direction of the finger. In this way, even if there are many kinds of scene setting information and all the pictorial signs corresponding to the many kinds of the scene setting information cannot be displayed simultaneously on the scene operation screen, a user can select desired scene setting information by scrolling the pictorial signs.

The storage unit 32 stores the number of selection of the pictorial signs indicating the scene setting information. The display unit 31 displays the pictorial signs on the scene operation screen in order of priority depending on the number of selection of the pictorial signs indicating the scene setting information stored in the storage unit 32. The order of priority may be started from the front pictorial sign or the central pictorial sign. However, it is preferred that the pictorial sign of the highest priority is arranged in a position most remarkable to the user's eyes when the main menu screen is changed to the scene setting screen on the display unit 31. In this way, the pictorial signs indicating the frequently-used scene setting information are first displayed when the main menu screen is changed to the scene operation screen. This reduces the time and effort required in scrolling the pictorial signs, consequently improving the convenience of operation.

Figure 12:
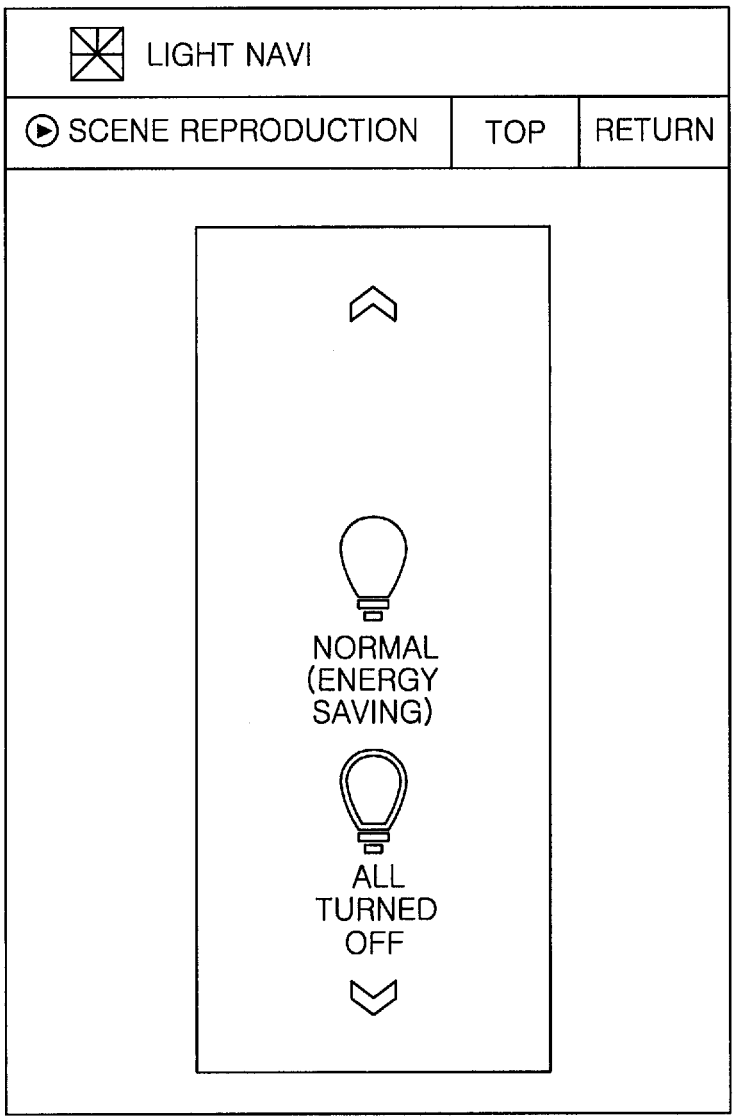
FIG. 12 is a view for explaining the scene operation screen at the time when the orientation of the controller is changed.

The display unit 31 changes the arrangement direction of the pictorial signs indicating the scene setting information on the scene operation screen, depending on the orientation of the controller 3 sensed by the orientation sensor 36. In the present embodiment, the display unit 31 has a rectangular shape and the scene setting information is arranged along the longitudinal direction of the display unit 31. When the controller 3 is held such that the longitudinal sides of the display unit 31 lie in the horizontal direction, the arrangement direction of the pictorial signs shown in FIG. 11 is regarded as the horizontal direction. On the contrary, when the controller 3 is held such that the longitudinal sides of the display unit 31 lie in the vertical direction, the arrangement direction of the pictorial signs shown in FIG. 12 is regarded as the vertical direction. Additionally, in the event that the controller 3 is held in the vertical direction, the logo and various buttons other than the scene operation screen are displayed on the display unit 31 in conformity with the vertical direction. This makes it possible to increase the number of pictorial signs that can be displayed at the same time.

When performing the scene reproduction, the lighting states of the lighting devices 2 are changed from the previous lighting states prior to the scene reproduction. At this time, if the lighting states of the lighting devices are changed abruptly, it sometimes makes a user feel unpleasant. For this reason, in the scene reproduction process, the lighting states of the lighting devices 2 are gradually changed for a predetermined period of time from before the scene reproduction to the completion of the scene reproduction, which is called a transition time.

A standard transition time is set for every kind of the scene setting information. For example, if the normal lighting is changed to all-turned-off, there is provided a standard transition time of about 10 seconds so that a user can cope with the ambient brightness change. In general, when the dimming ratio is high, the variation of the dimming ratio in the scene reproduction is large. Therefore, the transition time is set to be longer. On the other hand, if the dimming ratio is low, the transition time is set to be shorter.

In the present embodiment, the input processing unit measures a contact time period of the operation instruction position sensed by the operation unit 37. The input processing unit 34 changes the transition time depending on the time period for which the pictorial sign, indicating the scene setting information to be reproduced, is being touched by the operation instruction on the scene operation screen. For example, if a user presses the pictorial sign on the scene operation screen for 2 seconds or more, the transition time is set longer than the standard transition time in proportion to the pressed time. Alternatively, if a user touches twice the pictorial sign on the scene operation screen, the transition time is set shorter than the standard transition time. In other words, the transition time in the scene reproduction is adjusted depending on the time period for which a user keeps touching the pictorial sign.

Figure 13A:
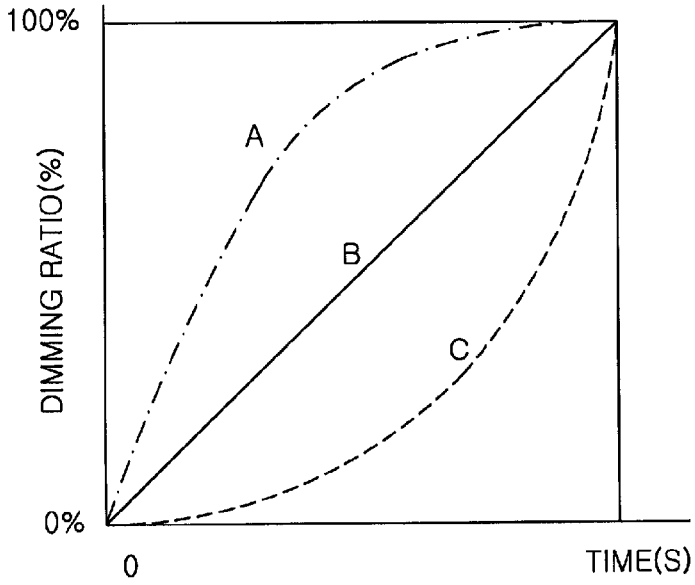
FIG. 13A is a view representing second lighting condition curves stored in the controller.
Figure 13B:
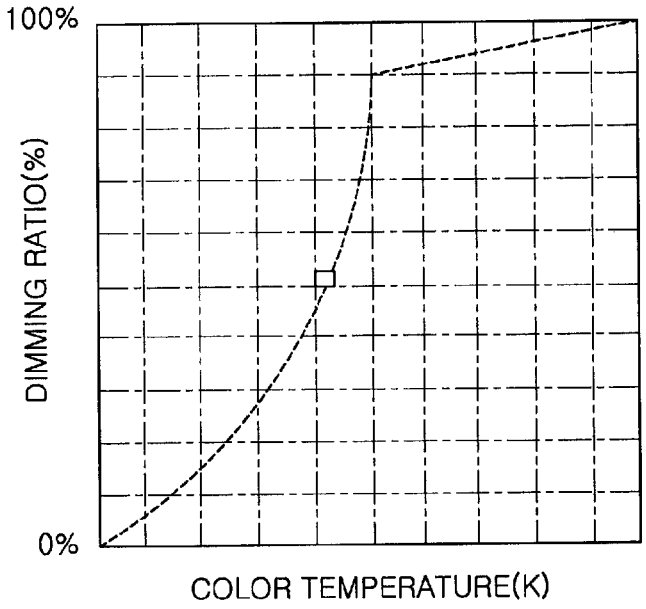
FIG. 13B is a view representing a first lighting condition curve.
Figure 15A:
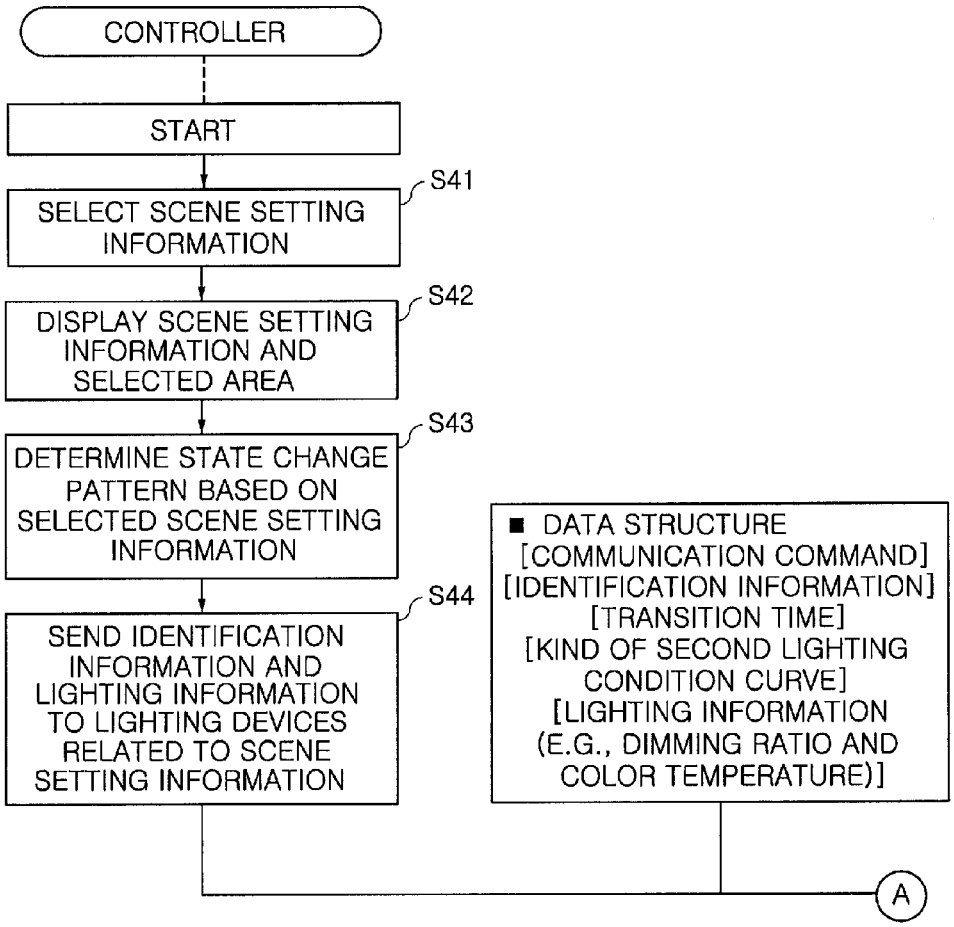
FIGS. 15A and 15B are a flowchart illustrating another example of a data transmitting/receiving operation of the controller and the lighting devices of the lighting system.
Figure 15B:
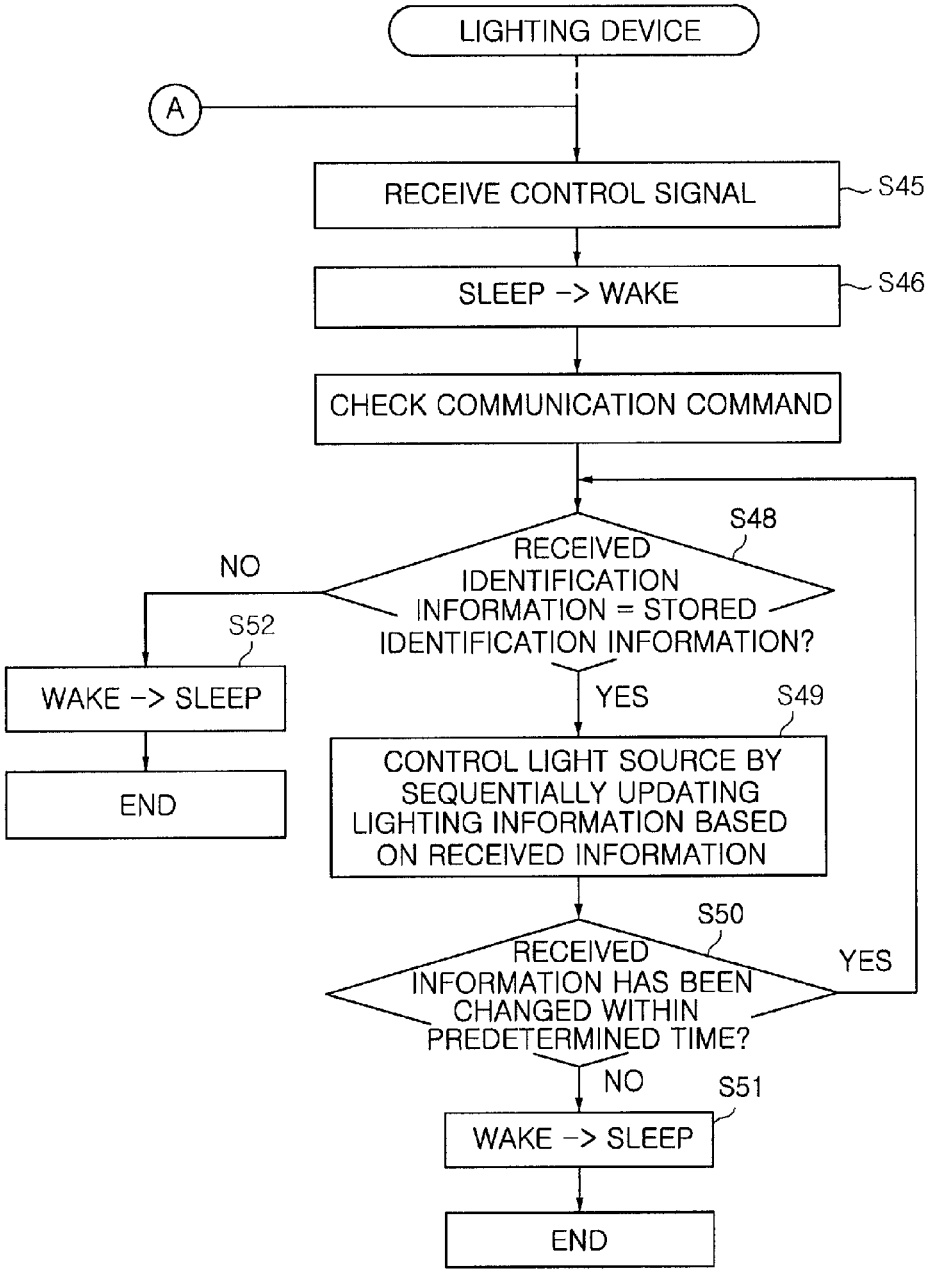

The storage unit 32 stores a second lighting condition curve, in which either one of the two kinds of lighting conditions of the lighting devices 2 is correlated with the transition time which is required until the lighting devices are turned on based on the scene setting information regarding the state change patterns. FIG. 13A illustrates three kinds of the second lighting condition curves (dimming ratio curves A, B and C), in which the lighting condition associated with the dimming ratio of the lighting devices 2 is correlated with the transition time.

The dimming ratio curve A is set in such a way that the dimming ratio per unit time has a large variation width at a relatively low dimming ratio but has a small variation width at a relatively high dimming ratio. The dimming ratio curve A is suitable for use in, e.g., a case where a user wants to quickly turn on the lighting devices 2 when returning home. The dimming ratio curve B is suitable for a standard use because the dimming ratio in the dimming ratio curve B is provided to be consistently changed throughout the transition time. The dimming ratio curve C is set in such a way that the dimming ratio per unit time has a large variation width at a relatively high dimming ratio but has a small variation width at a relatively low dimming ratio. The dimming ratio curve C is suitable for use in, e.g., a case where a user takes a rest in a living room and wants to gently dim down the lights of the lighting devices 2.

As described above, the storage unit 32 stores the first lighting condition curve, in which two kinds of lighting conditions (the dimming ratio and the color temperature) of the lighting devices 2 (see FIG. 13B) are correlated with each other. When the transition time is determined by the user's operation instruction, the control unit 35 determines one of the lighting conditions (herein, the dimming ratio) of the lighting devices 2 along the second lighting condition curve. When the one of the lighting conditions (the dimming ratio) is determined, the control unit 35 automatically determines the other (the color temperature) of the lighting conditions along the first lighting condition curve.

In other words, a user just only selects the pictorial sign indicating the scene setting information displayed on the display unit 31 and adjusts the touching time period on the pictorial sign, whereby not only the transition time until the completion of scene reproduction but also the dimming ratio and the color temperature in the scene reproduction are automatically determined. Accordingly, a user can easily and intuitively set the dimming ratio and the color temperature for the scene reproduction, even if less habituated to the setting of the lighting information of the lighting devices 2.

As illustrated in FIG. 14A, the storage unit 32 stores: different kinds of scene setting information; the scene numbers allotted to the respective scene setting information; the second lighting condition curves applicable to the respective scene setting information; and the standard transition time of the respective scene setting information, in the form of a table. The second lighting condition curves (A, B and C) are set suitable for the respective scene setting information.

As shown in FIG. 14B, the storage unit 32 stores: the scene numbers allotted to the respective scene setting information; the target areas for scene reproduction corresponding to the scene numbers; and the identification information and lighting information of the lighting devices 2 in the target areas, in the form of a table. For example, when a user wants to turn off all the lighting devices 2 installed within a house, the user touches twice the pictorial sign "ALL-TURNED-OFF" shown in FIG. 10. Then, all the lighting devices 2 are turned off within a time shorter than the standard transition time (10 seconds in FIG. 14A), e.g., within 5 seconds.

The transition time is changed depending on the orientation of the controller 3 sensed by the orientation sensor 36 and the contact time period for which the pictorial sign, indicating the scene setting information to be reproduced, is being touched by the operation instruction of a user on the scene operation screen. For example, if the controller 3 is vertically held by a user, it is highly probable that a user is in a dynamic state, e.g., walking or moving. In this case, the control unit 35 sets the transition time shorter than the transition time determined by the contact time period without considering the orientation of the controller 3 so that the scene reproduction can be performed substantially on a real time basis.

On the other hand, if the controller 3 is horizontally held by a user, it is highly probable that a user is in a static state, e.g., taking a rest on a chair. In this case, the control unit 35 sets the transition time longer than the transition time determined by the contact time period without considering the orientation of the controller 3 so that the scene reproduction can be performed at a low speed so as not to be noticed by a user. Accordingly, the transition time can be optimized by being adjusted depending on the holding state of the controller 3.

Now, a flow of the data transmission/reception performed between the controller 3 and the lighting devices (the lighting devices A and B in FIGS. 3A and 3B) will be described with reference to FIGS. 15A to 17 in addition to FIGS. 3A and 3B. If the scene setting information is selected in the operation unit 37 in step S41, the controller 3 displays, in step S42, a first operation screen including the pictorial sign indicating the selected scene setting information and the first image indicating the target area to which the selected scene setting information is applied (see FIG. 16). The first operation screen shown in FIG. 16 is identical in the target area with the first operation screen shown in FIG. 4 but differs in the viewing point from the first operation screen shown in FIG. 4.

Figure 16:
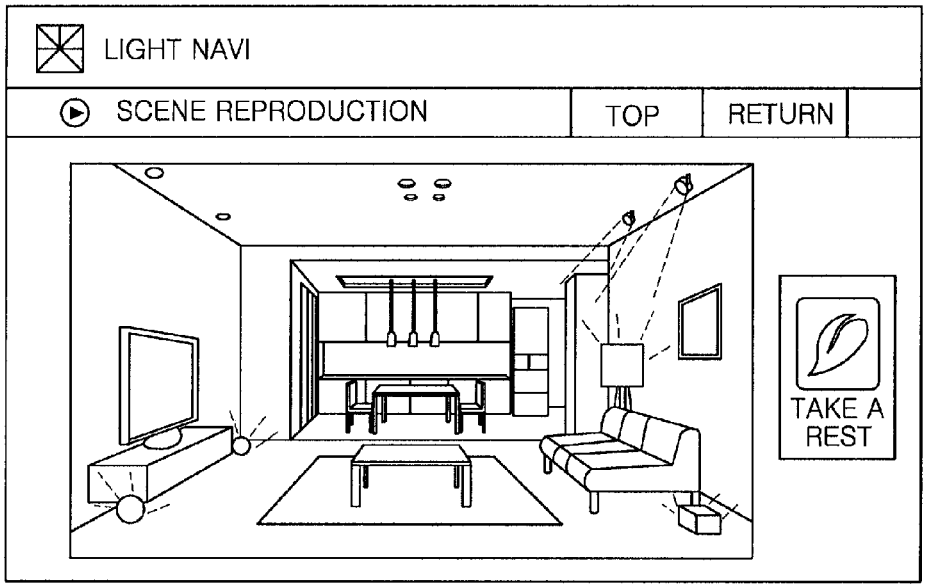
FIG. 16 is a view for explaining a first operation screen and a pictorial sign indicating the scene setting information, both of which are displayed on the controller.

Further, the controller 3 determines the state change pattern based on the selected scene setting information in step S43 and displays, as shown in FIG. 16, the state change pattern of the lighting devices 2 allotted to the selected scene setting information on the display unit 31. Thereafter, in step S44, the controller 3 sends, to the lighting devices 2 associated with the selected scene setting information, a control signal containing the identification information, lighting information, transition time, and second lighting condition curve of the associated lighting devices 2.

In each of the lighting devices 2, when the transmitting/receiving unit 22 receives the control signal from the controller 3 in step S45, a mode is changed from a sleep mode to a wake mode in step S46. Then, the control signal converting unit 23*c* of the control unit 23 compares the identification information contained in the control signal received by the transmitting/receiving unit 22 to its own identification information stored in the storage unit 23*a* in step S48. If the two pieces of identification information thus compared are equal to each other, the flow goes to step S49, and if not, the flow goes to step S52 to start the sleep mode.

In step S49, if the lighting information contained in the control signal received by the transmitting/receiving unit 22 is dimming ratio information, the control signal converting unit 23*c* converts the dimming ratio information as the control signal to a PWM signal having a corresponding on-duty ratio and outputs the PWM signal to the drive signal converting unit 23*d*. Then, in the same step S49, the drive signal converting unit 23*d* outputs a duty signal to turn on the light source 21. This also holds true in respect with other kinds of lighting information.

If the received information is changed within a predetermined period of time in step S50, the flow returns to step S48 and the two pieces of the identification information stated above are again compared to each other. If the received information is not changed within a predetermined period of time in step S50, a sleep mode is started in step S51 and the light source 21 is continuously turned on based on a constant duty signal.

In this manner, each of the lighting devices 2 determines whether or not itself is a control target, based on the identification information contained in the control signal received from the controller 3. Based on the scene setting information, the lighting devices 2 are turned on in accordance with a predetermined state change pattern.

Figure 17A:
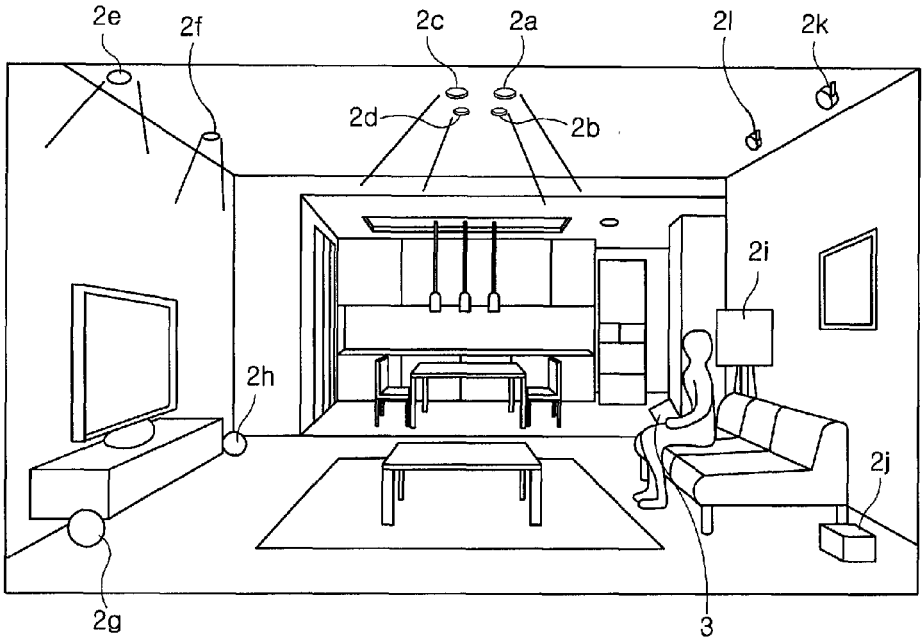
FIGS. 17A and 17B are views showing the scene setting information ("TAKE A REST") reproduced in a target area (the living room)
Figure 17B:
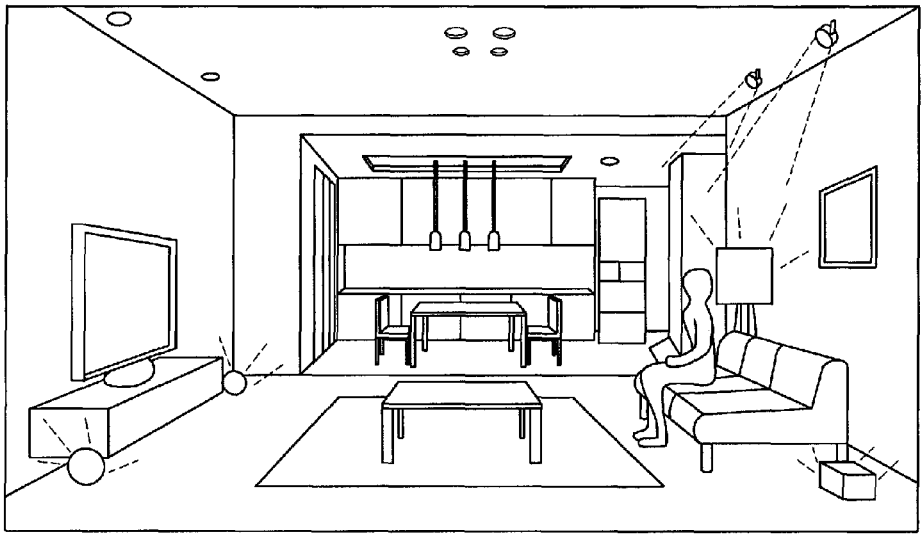

FIGS. 17A and 17B illustrate a scene image before and after scene reproduction, respectively, in a living room that employs the lighting system 1. In the scene shown in FIG. 17A, it is assumed that a normal lighting is performed. Reference numerals of the lighting devices 2 are depicted in FIG. 17A but are omitted in FIG. 17B.

In the scene shown in FIG. 17A, a plurality of down-lights (lighting devices 2*a* to 2*f*) arranged on a ceiling is turned on at a relatively high dimming ratio. Thus, the living room space is brightly illuminated. In this state, it is assumed that a user touches twice the pictorial sign indicating the scene setting information "TAKE A REST" on the display unit 31 of the controller 3. At this time, the transition time is set shorter than the standard transition time of the scene setting information "TAKE A REST". Accordingly, the dimming ratio of the lighting devices 2 is set low (see FIG. 13A) and the color temperature is also set low (see FIG. 13B).

The identification information of the lighting devices (e.g., the lighting devices 2*g* to 2*l*) allotted to the scene setting information "TAKE A REST" and the lighting information set as above are outputted from the controller 3 to the lighting devices 2. The lighting devices 2 that have confirmed their identification information are turned on within a relatively short transition time in the above-described example, in accordance with the received lighting information. For example, as in the scene shown in FIG. 17B, the local lighting devices such as the movable lighting 2*g* and 2*h*, the light stand (the lighting device 2*i*), the floor-installed lighting (the lighting device 2*j*) and the spotlights (the lighting devices 2*k* and 2*l*) are mildly turned on at a dimming ratio and a color temperature for realizing the scene of "TAKE A REST".

In accordance with the lighting system 1 described above, if an operation instruction is made on the scene operation screen displayed on the display unit 31 of the controller 3 with respect to the pictorial sign indicating the scene setting information, corresponding scene setting information is selected. The state change pattern of the allotted lighting device 2 is displayed in the form of a diagram on the display unit 31. Therefore, by merely touching the pictorial sign indicating the scene setting information, it is possible for even a general user to intuitively set the scene setting information while imaging the target area in which the lighting devices are arranged. In the above-mentioned description, the "dimming ratio" is first automatically set depending on the determined transition time. Alternatively, the "color temperature" may be first automatically set and then the "dimming ratio" may be set on the basis of the first lighting condition curve.

Figure 18A:
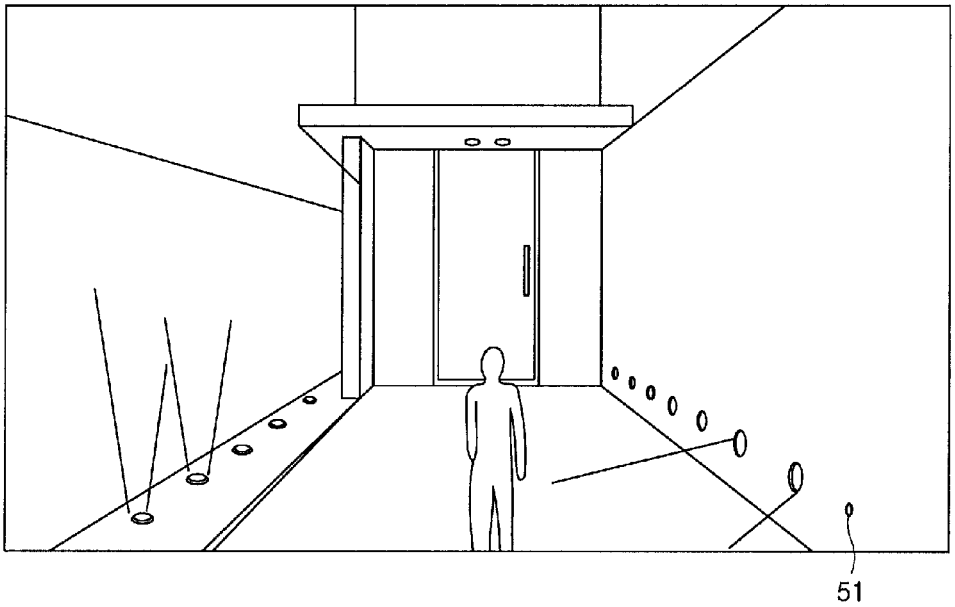
FIGS. 18A, 18B and 18C are views showing the scene setting information ("I AM HOME") reproduced in a target area (the entrance)
Figure 18B:
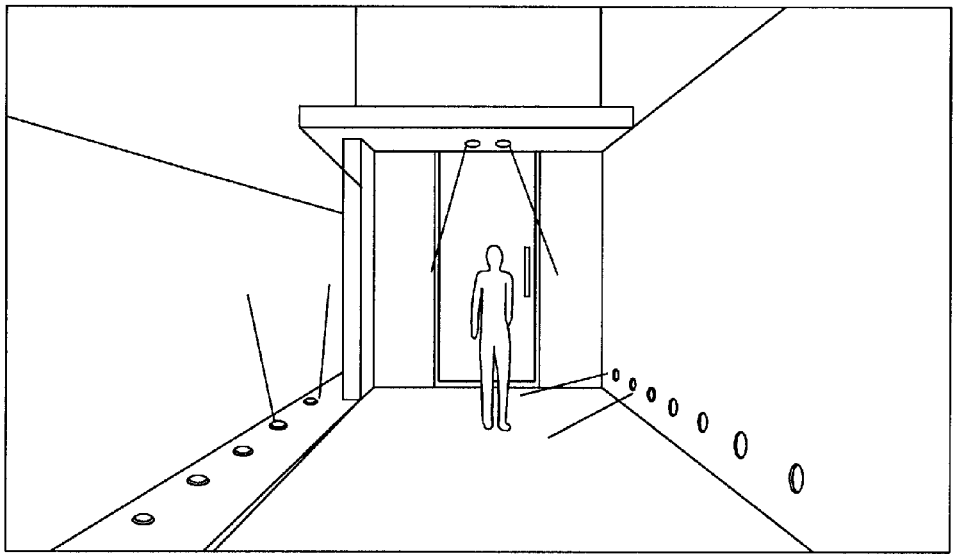
Figure 18C:
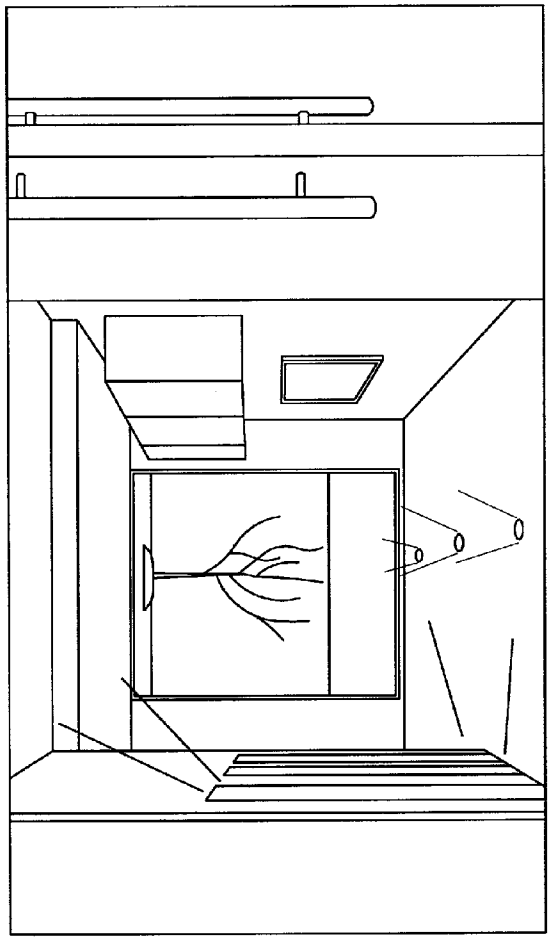

The scene setting information includes not only a state change pattern in which the lighting devices 2 allotted to the scene setting information are simultaneously turned on at one time but also a state change pattern in which the lighting devices 2 allotted to the scene setting information are individually turned on at a predetermined time interval. If, for example, the scene setting information "I AM HOME" is selected, as shown in FIGS. 18A to 18C, the lighting devices 2 arranged around the entrance (the porch approach, the outer porch, the inner porch and the indoor passageway) are sequentially turned on along the returning route of a user.

Figure 19A:
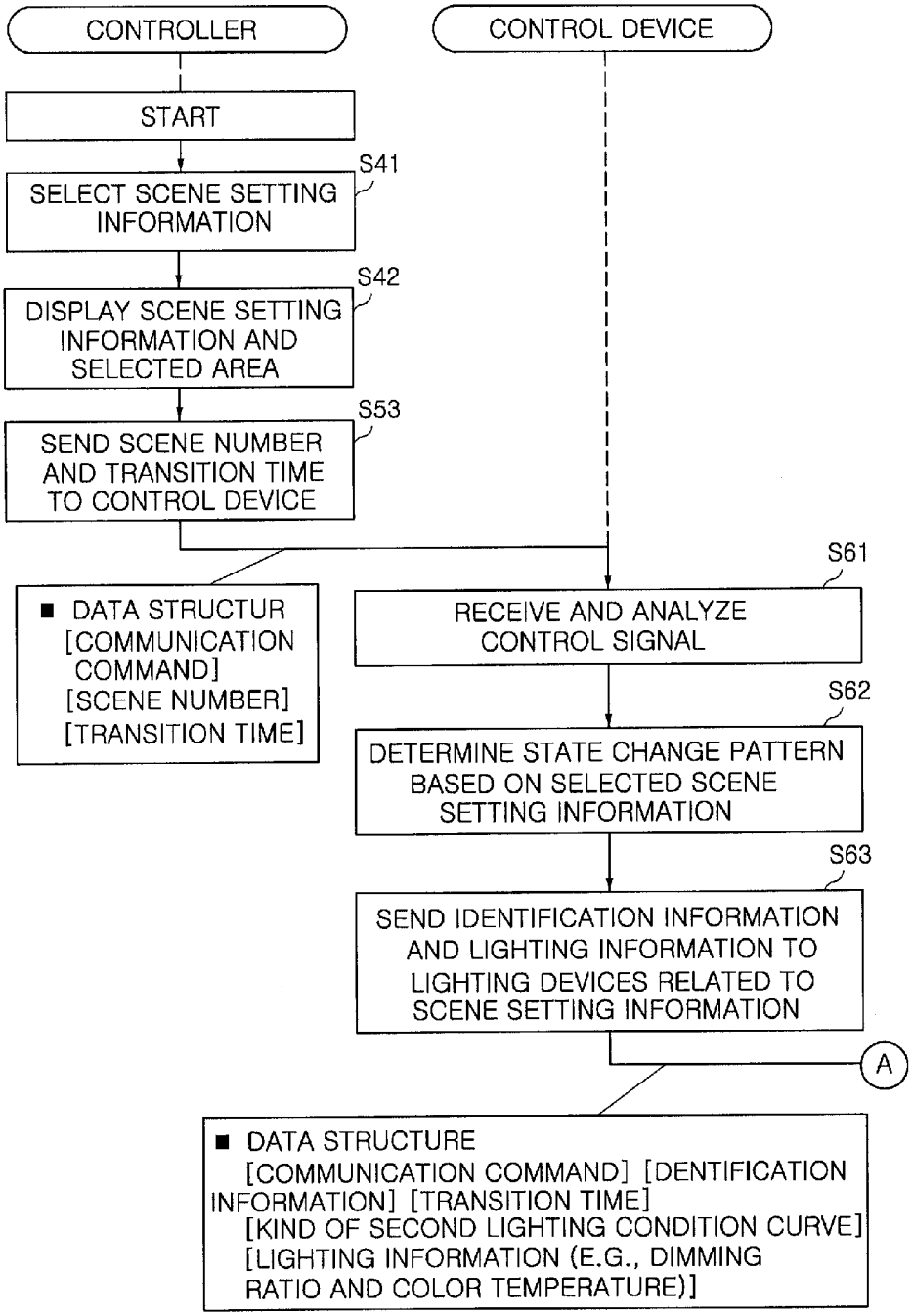
FIGS. 19A and 19B are a flowchart illustrating still another example of a data transmitting/receiving operation performed through a control device in the lighting system.
Figure 19B:
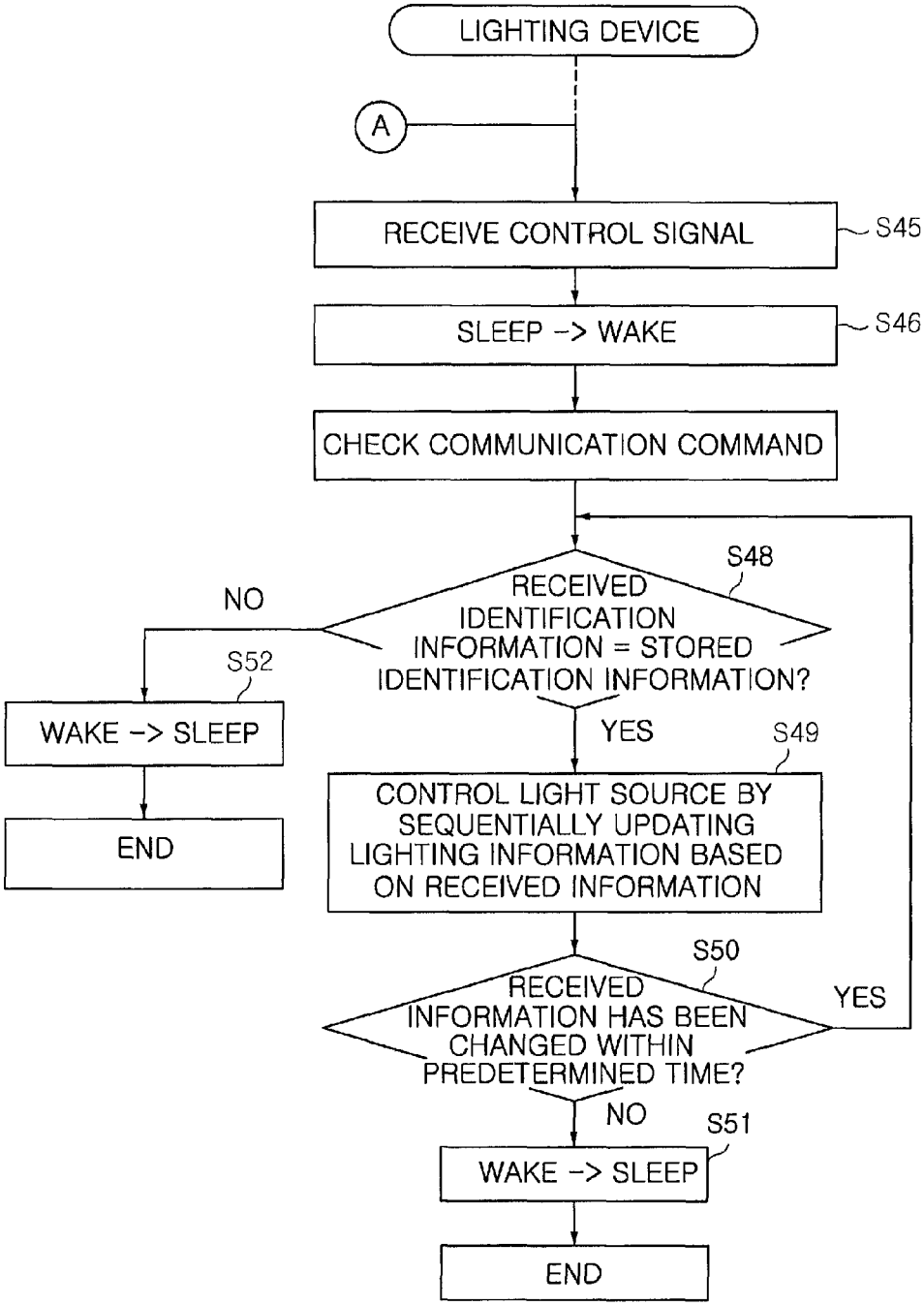

A flow of the data transmission/reception performed between the controller 3 and the lighting devices 2 (the lighting devices B and C in FIGS. 3A and 3B) through the control device 4 is shown in FIGS. 19A and 19B. In this flow, the controller 3 sends a control signal containing the scene number of the selected scene setting information and the transition time determined by the user's touching operation to the control device 4 in step S53.

Then, the control device 4 receives and analyzes the control signal in step S61 and determines the state change pattern based on the selected scene setting information in step S62. Thereafter, in step S63, the control device 4 sends, to the lighting devices 2 allotted to the scene setting information, the identification information and lighting information of the allotted lighting devices 2. Other operations remain the same as those of the flow shown in FIGS. 15A and 15B.

Figure 20:
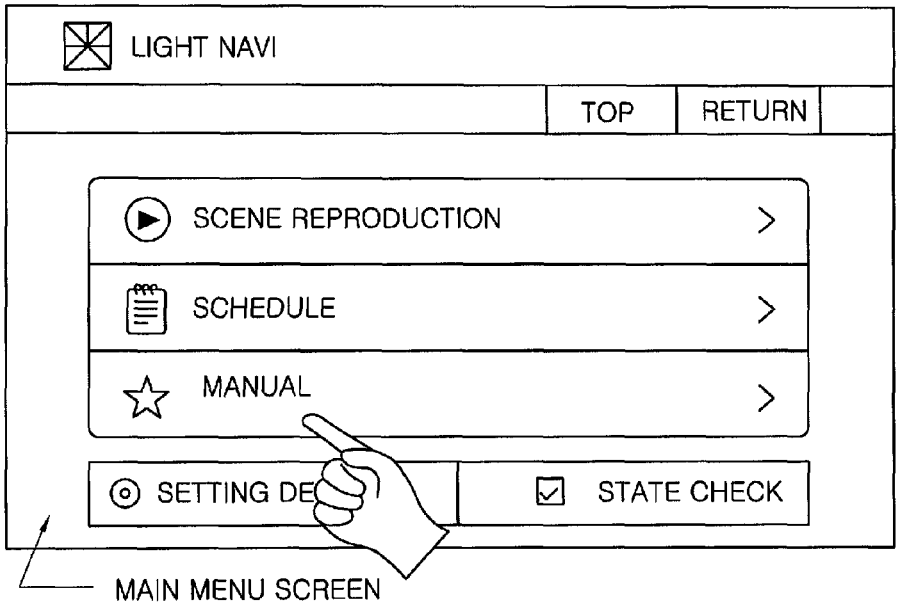
FIG. 20 is a view for explaining a main menu screen displayed on the controller.
Figure 21:
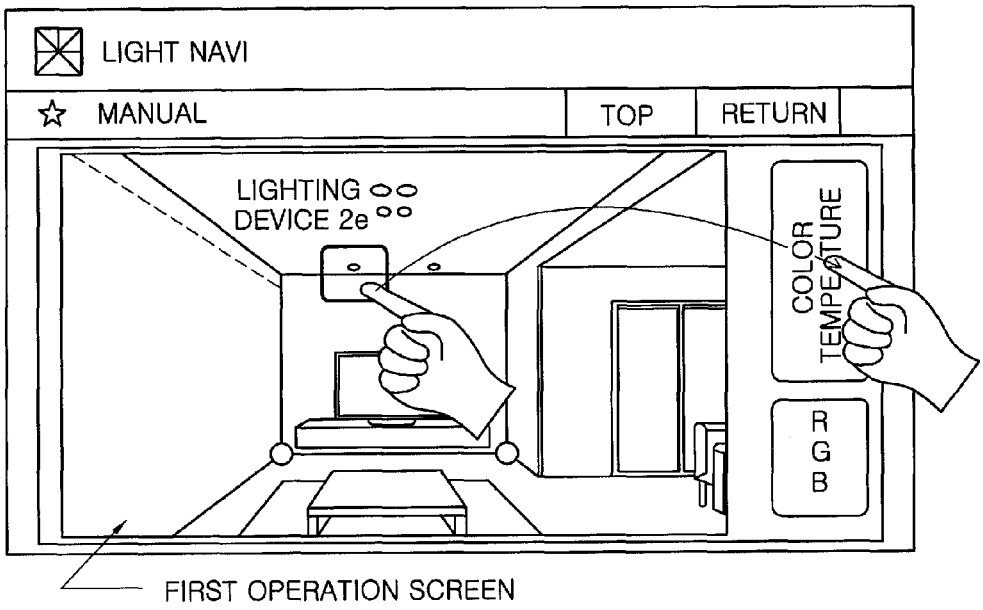
FIG. 21 is a view for explaining a first operation screen displayed on the controller.

Now, a procedure of individually and manually setting the lighting conditions of the lighting devices 2 using the controller 3 will be described with reference to FIGS. 20 to 25. If a user touches the command "MANUAL" with his or her finger as shown in FIG. 20, the display unit 31 displays a first operation screen as illustrated in FIG. 21. The first image in which the xyz coordinate system of the lighting devices 2 (2*a* to 2*h*) in the lighting system 1 shown in FIG. 1 is arranged in the three-dimensional space of a room having the lighting devices 2 arranged therein, the "COLOR TEMPERATURE" button for setting the dimming ratio and color temperature of the lighting devices 2, and the "RGB" button for setting the chromaticity and the like in the RGB system are displayed on the first operation screen.

If a user touches an image of the lighting device 2 to be controlled on the display unit 31 (the operation unit 37) on which the first operation screen is displayed, the touched lighting device 2 is surrounded by a frame line. At this time, letters (names in FIG. 21) indicating the identification information of the lighting device 2 are popped up in the vicinity of the frame line. Thereafter, if a user touches the "COLOR TEMPERATURE" button, the lighting device 2 surrounded by the frame line is designated as a control target. In addition, prior to touching the "COLOR TEMPERATURE" button, if the lighting device 2 surrounded by the frame line is touched again, the frame line disappears and the designation of the lighting device 2 is cancelled.

Figure 22:
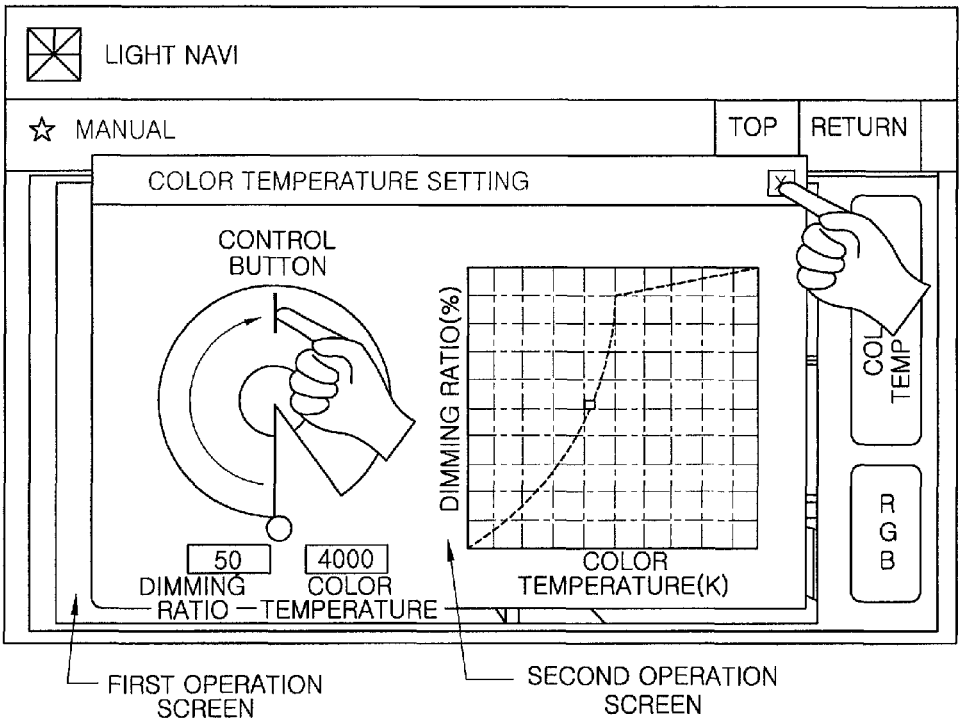
FIG. 22 is a view for explaining a second operation screen (setting of the color temperature) superposed on the first operation screen displayed on the controller.

If the lighting device 2 is designated as the control target, as shown in FIG. 22, the display unit 31 dialog-displays the second operation screen for setting the lighting information of the lighting device 2 such that the second operation screen is superposed on the first operation screen. On the second operation screen, a control button symbolizing a rotary volume controller and a graph showing a dimming/toning curve (a first lighting condition curve) in which the dimming ratio and the color temperature are correlated with each other are displayed as a second image. Further, a title bar showing a set title name and a close button for terminating the second operation screen are also displayed on the second operation screen.

If a user touches the control button rotationally on the display unit 31 (the operation unit 37) on which the second operation screen is displayed, the lighting information of the designated lighting device 2, i.e., the dimming ratio and the color temperature are changed along the dimming/toning curve drawn in the graph. If a user stops the operation of rotationally touching the control button, the dimming ratio and the color temperature indicated at that time are set as the lighting information of the designated lighting device 2.

Figure 23:
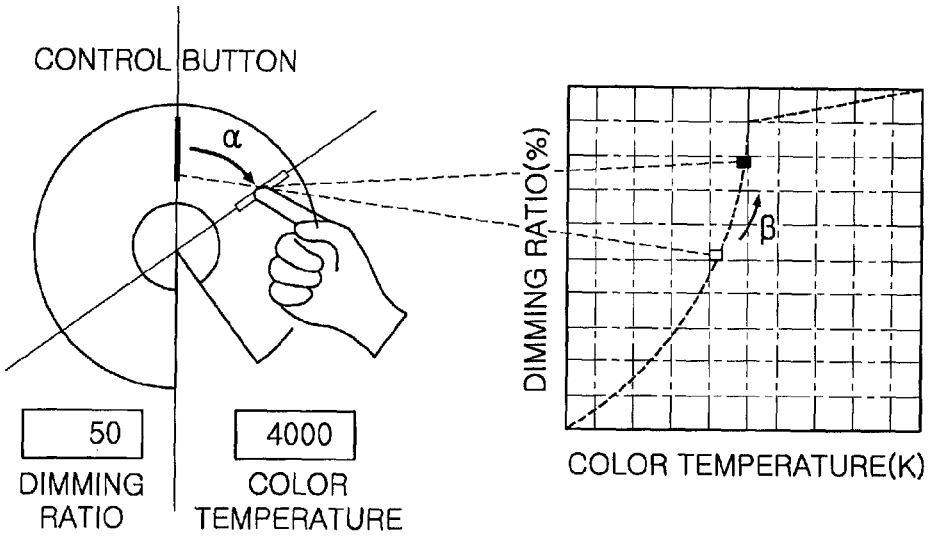
FIG. 23 is a view depicting a second image of the second operation screen displayed on the controller, which shows correlation of the dimming ratio and the color temperature.

More specifically, as shown in FIG. 23, if the touching point of the user's finger (the operation instruction) is rotationally moved about the center point of the control button, the lighting information to be set is changed depending on the rotation angle. In the present embodiment, the rotation angle $\alpha$ of the control button and the length $\beta$ of the dimming/toning curve are correlated to each other in a constant proportion. Alternatively, the rotation angle $\alpha$ of the control button and the variation of the dimming ratio may be correlated to each other in a constant proportion, or otherwise, the rotation angle $\alpha$ of the control button and the variation of the color temperature may be correlated to each other in a constant proportion.

Here, the dimming ratio and the color temperature are changed along the dimming/toning curve drawn in the graph of the second operation screen. It is known that the law called Kruithof effect is applied between the color temperature and illuminance of illumination light. According to this law, the light having a low color temperature gives a mild, warm and pleasant feeling when the illuminance level is low, but gives a sweltering and unpleasant feeling when the illuminance level is higher than a predetermined value. On the contrary, the light having a high color temperature gives a fresh, brisk and pleasant feeling at a high illuminance level, but gives a chilly, gloomy and unpleasant feeling at a low illuminance level.

Also known is a Kruithof curve that defines the illuminance and the color temperature such that the most-pleasant color temperature can be obtained in every illuminance level. According to the Kruithof curve, the variation of the dimming ratio with respect to the variation of the color temperature is small in a low color temperature zone (3000 K or lower) and grows larger as going to a middle color temperature zone (3000 K to 5000 K). In a high color temperature zone (5000 K or higher), the variation of the color temperature with respect to the variation of the dimming ratio is large.

If the Kruithof curve is used as the dimming/toning curve of the graph, the dimming ratio and color temperature for giving a pleasant feeling can be automatically set with a user merely touching the control button of the second operation screen rotationally. The Kruithof curve is one example of the dimming/toning curve. For instance, the dimming/toning curve (line) may be set in such a way that the dimming ratio and the color temperature are directly proportional to each other. Moreover, the dimming/toning curve may be set in such a way that the dimming ratio has a larger variation with respect to the variation of the color temperature in the low color temperature zone and has a smaller variation in the middle color temperature zone and high color temperature zone.

These dimming/toning curves are stored in the storage unit 32 of the controller 3. It may also be possible to download a dimming/toning curve depending on the intended use from the external server 5 shown in FIGS. 3A and 3B. In addition, a user may individually set the dimming/toning curves. If the rotation angle $\alpha$ of the control button is correlated with the variation of the dimming ratio or the color temperature at a constant proportion, when setting either the dimming ratio or the color temperature, the other is automatically set along the dimming/toning curve. This helps reduce the frequency of the operation and enhance the ease of use.

Figure 24:
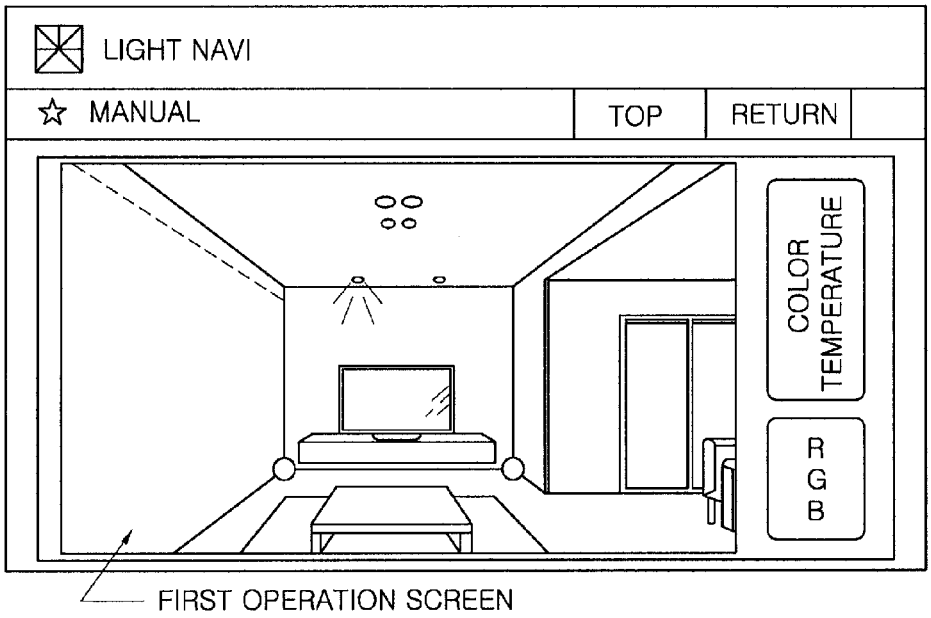
FIG. 24 is a view for explaining a first operation screen displayed on the controller.

Thereafter, if a user closes the second operation screen, the display unit 31 displays the image of the designated lighting device 2 on the first operation screen in a highlighted manner as shown in FIG. 24 to thereby show that the designated lighting device 2 is turned on at the set dimming ratio and the set color temperature. At this time, the display unit 31 displays, in a highlighted manner, not only the image of the designated lighting device 2 but also the area information including the peripheral area of the designated lighting device 2. In other words, the lighting information set on the second operation screen is visually reflected in the first operation screen.

Figure 25:
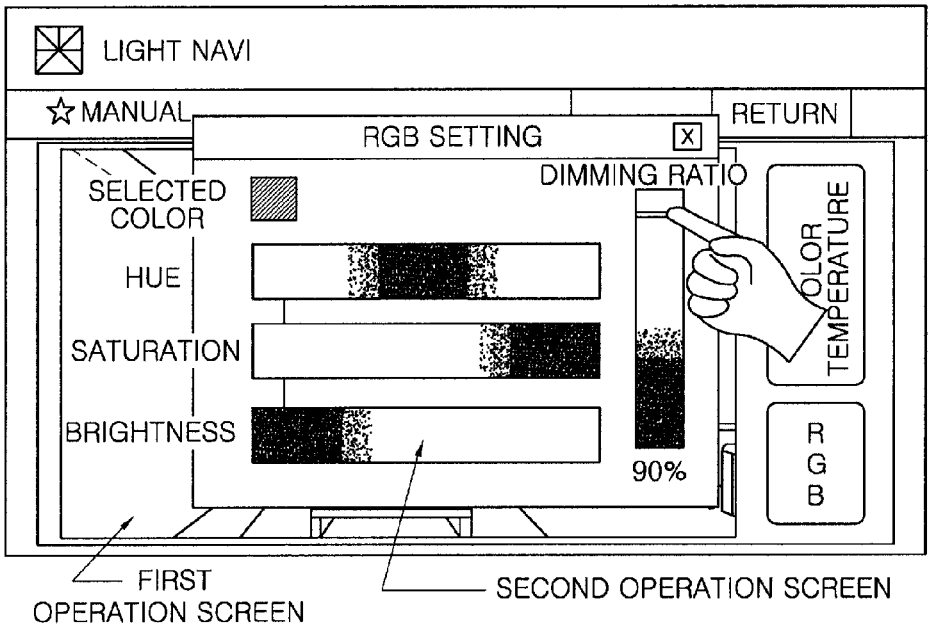
FIG. 25 is a view for explaining a second operation screen (RGB setting) superposed on the first operation screen displayed on the controller.

If a user touches the "RGB" button on the first operation screen shown in FIG. 21, the display unit 31 displays the second operation screen for setting the chromaticity and the like in the RGB system, as shown in FIG. 25, such that the second operation screen can be superposed on the first operation screen. On the second operation screen, as the second image, there are displayed: a section indicating the color of illumination light selected by a user; three horizontal bars respectively indicating in color the hue, the saturation and the brightness; and a vertical bar indicating the dimming ratio of the lighting device 2. If a user touches the regions of the horizontal bars and the vertical bar on the second operation screen, the chromaticity and the like are set. If the second operation screen is closed, the lighting information such as the set chromaticity and the like is reflected in the image of the lighting device 2 and its peripheral area on the first operation screen.

Since the respective parameters (the lighting information) such as the chromaticity and the like are displayed in color on the second operation screen, it is possible for a user to more intuitively set the chromaticity of illumination light than when the parameters are displayed in, e.g., numerical values. Further, since the parameters are collectively displayed on the second operation screen, a user can individually and specifically set the respective kinds of lighting information at the user's desire. Furthermore, on the first operation screen after the closure of the second operation screen, the color tone of the peripheral area of the lighting device 2 is changed depending on the lighting information of the lighting device 2. It makes therefore possible for a user to more specifically image the space to be produced by the lighting.

In the lighting system 1 described above, the display unit 31 of the controller 3 three-dimensionally displays, on the first operation screen, the area information including the area in which the lighting devices 2 are arranged. Then, the second operation screen for setting the lighting information of the lighting devices 2 is dialog-displayed on the first operation screen. If the lighting information is set, the identification information of the lighting devices 2 and their peripheral area information are highlighted on the first operation screen. Accordingly, the area (the target area) in which the lighting devices 2 to be controlled are arranged can be imaged to a user. This enables a general user to intuitively select the lighting device 2 to be controlled and to efficiently set the lighting attribute information such as the lighting state and the like.

The lighting information and identification information of the lighting devices 2 set by the controller 3 are included in the control signal outputted from the controller 3. The control signal is outputted to the respective lighting devices 2 either directly or through the control device 4. Each of the lighting devices 2 reads the lighting information from the received control signal and turns on the light source 21 based on the lighting information, as seen in the flow illustrated in FIGS. 6A and 6B to FIGS. 8A and 8B. Accordingly, the lighting information of the lighting devices 2 virtually displayed by the controller 3 is realized in the actual lighting devices 2.

The present invention is not limited to the aforementioned embodiment but may be modified in many different forms. For example, a diagram or the like indicating the lighting device 2 may be stored as the identification information of the lighting device 2 in the storage unit 23*a* of the lighting device 2. This identification information may be updated by the controller 3. Moreover, the controller 3 may be provided with a self-position detecting means using a GPS or the like and may automatically detect a room in which a user holding the controller 3 exists. This enables a user to open the first operation screen without selecting a room.

In respect to the scene setting information "I AM HOME" shown in FIGS. 18A to 18C, a human detecting sensor 51 may be provided in the porch approach and synchronized with the controller 3. Accordingly, scene reproduction is triggered by a detection signal outputted from the human detecting sensor 51. The human detecting sensor 51 may be installed in an outdoor lighting device.

While the invention has been shown and described with respect to the embodiments, it will be understood by those skilled in the art that various changes and modifications may be made without departing from the scope of the invention as defined in the following claims.

What is claimed is:

1. A lighting system, comprising:

one or more lighting devices; and a controller configured to set lighting control contents of the lighting devices, wherein the controller includes:

a display unit for displaying attribute information which includes identification information and lighting information of the lighting devices;

an operation unit incorporated in the display unit and configured to detect an operation instruction;

an input processing unit for acquiring coordinate information indicating a position of the operation instruction detected by the operation unit;

a storage unit for storing the attribute information;

a transmitting unit for transmitting, to one of the lighting devices, a control signal including attribute information of the one of the lighting devices; and a control unit for controlling the transmitting unit to transmit the control signal in order to control lighting of one of the lighting devices based on the coordinate information acquired by the input processing unit, wherein the storage unit stores:

area information including one or more target areas in which the lighting devices are arranged;

the identification information of the lighting devices;

the lighting information regarding different lighting conditions of the lighting devices; and a piece of scene setting information regarding a state change pattern for changing a lighting state of the lighting devices allotted to each of the target areas, wherein the control unit controls the display unit to display a scene operation screen having one or more pictorial signs each indicating one piece of scene setting information stored in the storage unit; selects a piece of scene setting information represented by one of the pictorial signs of which the coordinate information is acquired by the input processing unit; and controls the display unit to display a state change pattern of each of the lighting devices allotted to the piece of scene setting information, wherein the each of the lighting devices determines whether or not the each of the lighting devices itself is a control target, based on the identification information included in the control signal received from the controller, and is turned on in accordance with the state change pattern when affirmative, wherein the storage unit further stores a lighting condition curve that is obtained by correlating two lighting conditions of the lighting devices, wherein, when one of the two lighting conditions is selected, the control unit selects the other of the two lighting conditions in accordance with the lighting condition curve, wherein the storage unit further stores another lighting condition curve in which either one of the two lighting conditions of the each of the lighting devices is correlated with a transition time required until the each of the lighting devices allotted to the piece of scene setting information is turned on based on the piece of scene setting information, and wherein, when the transition time is determined by the operation instruction, the control unit selects the one of the two lighting conditions in accordance with said another lighting condition curve, and selects the other of the two lighting conditions in accordance with the lighting condition curve.

2. The system of claim 1, wherein the two lighting conditions are dimming ratio and color temperature of the lighting devices.

3. The system of claim 1, wherein the input processing unit measures a time period for which the position of the operation instruction detected by the operation unit is being touched, and the control unit changes the transition time depending on a time period for which the indicated pictorial sign is being touched by the operation instruction on the scene operation screen.

4. The system of claim 1, wherein the controller further includes an orientation sensor for detecting orientation of the controller, wherein the input processing unit measures a time period for which the position of the operation instruction detected by the operation unit is being touched, and wherein the control unit changes the transition time depending on a time period for which the indicated pictorial sign is being touch by the operation instruction on the scene operation screen and the orientation of the controller detected by the orientation sensor.

5. The system of claim 4, wherein, depending on the orientation of the controller detected by the orientation sensor, the control unit controls the display unit to change arrangement direction of the pictorial signs on the scene operation screen.

6. The system of claim 1, wherein the input processing unit measures a travel length and a travel velocity of the operation instruction detected by the operation unit, and wherein the control unit controls the display unit to display the pictorial signs in a scrolling manner on the scene operation screen depending on the travel length and the travel velocity of the operation instruction.

7. The system of claim 1, wherein, when one of the pictorial signs or a vicinity of the one of the pictorial signs is selected by the operation instruction on the scene operation screen, the control unit controls the display unit to arrange the selected pictorial sign at the center of the scene operation screen in a highlighted manner.

8. The system of claim 1, wherein the storage unit stores the number of selection of each of the pictorial signs, and the control unit controls the display unit to display the pictorial signs on the scene operation screen depending on the number of selection of each of the pictorial signs stored in the storage unit.

9. The system of claim 1, wherein the control unit controls the display unit to two-dimensionally or three-dimensionally display a first operation screen having a first image that symbolizes area information of a target area assigned to the piece of scene setting information and identification information of lighting devices in the assigned target area;

wherein, when one of the lighting devices in the first image is selected as a control target by the operation instruction on the first operation screen, the control unit controls the display unit to dialog-display a second operation screen having a second image that symbolizes lighting information of the selected lighting device such that the second operation screen is superposed on the first operation screen; and wherein, when the lighting information of the lighting device is selected on the second operation screen, the control unit controls the display unit to display, on the first operation screen, the selected lighting device in a highlighted manner such that the selected lighting information is reflected on the first image.

* * * * *